US009334668B2

(12) United States Patent
Wijning et al.

(10) Patent No.: US 9,334,668 B2
(45) **Date of Patent: *May 10, 2016**

(54) MODULAR DRILLING RIG SYSTEM

(71) Applicant: ITREC B.V., Schiedam (NL)

(72) Inventors: Diederick Bernardus Wijning, Schiedam (NL); Joop Roodenburg, Delf (NL)

(73) Assignee: ITREC B.V., Schiedam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/854,959

(22) Filed: Sep. 15, 2015

(65) Prior Publication Data

US 2016/0002947 A1 Jan. 7, 2016

Related U.S. Application Data

(62) Division of application No. 14/383,411, filed as application No. PCT/NL2013/050133 on Mar. 1, 2013, now Pat. No. 9,169,698.

(60) Provisional application No. 61/607,309, filed on Mar. 6, 2012, provisional application No. 61/657,455, filed on Jun. 8, 2012.

(51) Int. Cl.

| | |
|---|---|
| ***E04B 1/343*** | (2006.01) |
| ***E04H 12/34*** | (2006.01) |
| ***E21B 7/02*** | (2006.01) |
| ***E21B 15/00*** | (2006.01) |
| ***E21B 19/20*** | (2006.01) |
| ***E21B 19/14*** | (2006.01) |
| ***E04B 1/19*** | (2006.01) |
| ***E04B 1/344*** | (2006.01) |
| ***E04H 12/18*** | (2006.01) |

(52) U.S. Cl.

CPC ..... *E04H 12/345* (2013.01); *E04B 1/19* (2013.01); *E04B 1/344* (2013.01); *E04B 1/34336* (2013.01); *E04H 12/187* (2013.01); *E21B 7/02* (2013.01); *E21B 15/00* (2013.01); *E21B 19/14* (2013.01); *E21B 19/20* (2013.01)

(58) Field of Classification Search

CPC ..... E21B 7/02; E21B 7/023; E21B 15/00; E04B 1/34363; E04B 1/3441

USPC ..... 52/115, 116, 118, 119, 123.1; 403/335

See application file for complete search history.

(56) References Cited

U.S. PATENT DOCUMENTS

| | | | |
|---|---|---|---|
| 3,228,151 | A | 1/1966 | Woolslayet et al. |
| 4,221,088 | A | 9/1980 | Patterson |
| 4,292,772 | A | 10/1981 | Borg et al. |
| 4,473,977 | A | 10/1984 | Reed |
| 4,759,414 | A | 7/1988 | Willis |
| 4,932,175 | A | 6/1990 | Donnally |
| 6,994,171 | B2 | 2/2006 | Orr et al. |

(Continued)

FOREIGN PATENT DOCUMENTS

WO WO 2009/106863 A2 9/2009

*Primary Examiner* — Patrick Maestri

(74) *Attorney, Agent, or Firm* — Birch, Stewart, Kolasch & Birch, LLP

(57) ABSTRACT

Modular transfigurable drilling rig system composed of multiple components, which system is transfigurable between a transport mode in which the components of the system are transportable and an operational mode in which the components are assembled to a drilling rig which is adapted to drill into a well centre in the ground.

10 Claims, 29 Drawing Sheets

(56) References Cited

U.S. PATENT DOCUMENTS

| | | | |
|---|---|---|---|
| 7,765,749 | B2 | 8/2010 | Palidis |
| 7,828,087 | B2 | 11/2010 | Vora |
| 2005/0241823 | A1 | 11/2005 | Beato et al. |
| 2007/0074460 | A1 | 4/2007 | Belik |
| 2009/0000218 | A1 | 1/2009 | Lee et al. |
| 2011/0072737 | A1 | 3/2011 | Wasterval |

MODULAR DRILLING RIG SYSTEM

This application is a Divisional of application Ser. No. 14/383,411 filed on Sep. 5, 2014, which is the national phase of PCT International Application No. PCT/NL2013/050133 filed on Mar. 1, 2013, and which claims priority to U.S. Provisional Application Nos. 61/607,309 filed on Mar. 6, 2012 and 61/657,455 filed on Jun. 8, 2012. The entire contents of all of the above applications are hereby incorporated by reference.

The present invention relates to a modular drilling rig system.

Modular drilling rigs have been used in the oil and gas industry, both in offshore drilling industry and on land for a considerable time. An early example of such a modular drilling rig is described in U.S. Pat. No. 3,228,151. In this document a drilling apparatus is disclosed comprising a base substructure having a base, an elevatable drilling floor and means between them for raising the floor, preferable hingable legs. A mast is provided, having rear legs extending upward from the substructure and front legs extending downward in front of the substructure, pivotal means supporting the front legs. The mast is swingable on said pivotal means.

According to this prior art, the drawworks are used to sequentially pivot the base substructure to the raised position to raise the drill floor, and to position the mast vertically above the drill floor and the well centre. A disadvantage of such a set-up is that the cables of the drawworks need to be reeved between a drawworks location comprising the winches and sheaves provided in the mast prior to raising the mast. Hence, prior to being able to raise the substructure and later the mast, the cables need to be reeved properly. In addition, this requires the drawworks to be suitable not only to be used during drilling operations, but also to be used in this setup to raise the mast and substructure. Another disadvantage is that this installation is complex and time-consuming.

It is an aim of the invention to provide a more efficient modular drilling rig system.

According to the present invention this is achieved by a modular transfigurable drilling rig system composed of multiple components, which system is transfigurable between a transport mode in which the components of the system are transportable and an operational mode in which the components are assembled to a drilling rig which is adapted to drill into a well centre in the ground, the system comprising:

- a base structure adapted to be positioned in the operational mode on the ground near a well centre, which base structure comprises:
  - one or more base members, e.g. base plates, adapted to be positioned on the ground,
  - one or more drill floor members adapted to form a drill floor in the operational mode, said drilling floor in the operational mode being located at an elevated position above said one or more base members and the well centre,
  - at least one bar-linkage mechanism comprising one or more beams that extend between a base member and a drill floor member, said one or more beams being pivotally connected to said base member and said drill floor member, which bar-linkage mechanism is operable to move between a transport position in which the drill floor member is in a lowered position relatively close to the base member, and in which transport position preferably said one or more beams of the bar-linkage mechanism are substantially parallel to the base member, and a raised position in which the drill floor member is in its elevated position,

- a drilling rig mast which is movable between a substantially horizontal position and an operational position vertically above the well centre, the drilling rig mast having a top end and a foot,
- at least one drive assembly to move the one or more drill floor members and the mast between the lowered and elevated position and the substantially horizontal position and the vertical operational position respectively, characterized in that at least one base member, at least one drill floor member, and an associated bar-linkage mechanism are integrated into a transportable base unit, preferably a non-wheeled containerized unit, which base unit is adapted to be placed on the ground to support the drilling rig thereon, and in that the drilling mast is in its substantially horizontal position connectable to the drill floor member and/or to the bar-linkage mechanism of said transportable base unit when placed on the ground, and in that said at least one drive assembly is integrated into the transportable base unit and engages on the bar-linkage member and/or the drill floor member thereof, said at least one drive assembly being embodied to move the drill floor member between the lowered and elevated position and simultaneously move the drilling mast—when connected to the floor member and/or the bar-linkage mechanism—between its substantially horizontal position and the vertical operating position thereof.

The provision in a rig of one or more, preferably two, transportable base units according to the invention is advantageous over the use of the drilling drawworks for erecting the drilling mast and also over the use of a drive assembly that engages directly on the mast itself, e.g. a complex and very long telescopic hydraulic jack engaging directly on the mast to erect said mast. Due to the use of one or more base units there is no need for modification of the drawworks so that they can be dedicated to their function in the drilling process.

The invention allows for an efficient installation once the drilling mast and base structure are positioned on the ground. Moreover, the provision of the one or more base units according to the invention allows for an advantageous embodiment of the drilling rig, in which the drawworks are no longer positioned on the ground in the drilling area, but are connected to the drilling mast in an elevated drawworks position The thus achieved clearance of the ground in the drilling area is very advantageous during drilling operations and enables a more efficient drilling process.

Preferably, the components of the rig, at least of the base structure and of the mast, have dimensions that allow the components to be transported on vehicles, e.g. trucks, e.g. on trailers, over land. In particular, the maximum dimensions of most components, e.g. feet, base units, mast sections, etc. correspond to those of standard ISO freight containers. Possibly one or more components are provided with ISO corner fittings to secure the component during transportation and possibly also for assembly of the rig. Even more preferably, the components also have a limited weight per component, e.g. a maximum weight per component of 25 tons. Such a limited weight may facilitate transport and enable a quick assembly and disassembly of the drilling rig according to the invention.

The components of the rig include a drilling rig mast, which is preferably composed of multiple sections, for example 2-4 sections, preferably three sections. Possibly, drilling equipment such as top drive, crown block and travelling block are integrated into one or more of the mast sections for transportation as integrated items. The mast sections need to be connected to form a drilling rig mast having a top end and a foot, which mast in the operational position is positioned vertically above the well centre to perform drilling activities.

In an embodiment, the base structure is composed of three main base structure components to be transported as separate components: a well base plate or well base member to be positioned on the ground adjacent the well centre, and two base units.

Other drilling rig components of the system may include e.g. drawworks, a blow out preventer (BOP), a pipe loader, a drillers cabin, pipe tubs, a pipe rack, mud pumps, shaker tanks, etc.

According to an embodiment of the invention, the driller's cabin is positioned on a drill floor member when the drill floor member is still in the lowered position. As such, upon raising the drill floor to the elevated position, the drillers cabin is simultaneously raised to its operational position.

In an embodiment of the drilling rig according to the invention, the foot of the drilling rig mast is to be connected pivotally to a base member and at a distance thereof to the bar-linkage or drilling floor of a base unit.

Possibly the bar-linkage mechanism includes one or more pivotal beams connecting the base member with a drill floor member.

Preferably the bar-linkage mechanism of the base unit is embodied to form a four-bar-linkage mechanism. The base member then forms the stationary base of the mechanism.

In one embodiment each base unit has two pivotal beams or pairs of parallel pivotal beams (in a pair one on the left-hand side and one on the right-hand side), each pivoted at their lower ends to the base member at spaced pivot axis locations and each pivoted at their upper ends to the drill floor member at spaced pivot axis locations.

In another embodiment each base unit has a single pivotal beam (or pair of parallel beams on opposed sides of the base unit) that is pivoted at its lower end to the base member and at its upper end to the drill floor member. A section of the mast then forms a second beam between a base member and the drill floor member, with said mast section being pivoted to the base member and to the drill floor member.

In yet another embodiment the drill floor member does not form part of the four-bar-linkage mechanism and instead an additional linkage member, e.g. a frame element extending below the drill floor when the rig is operative, is connected to the two pivotal beams to form the third mobile linkage member or is connected to the one pivotal beam of the base unit on the one hand and to the mast on the other hand to form the third mobile linkage member in said arrangement.

It is noted that a drill floor member may include the actual drill floor, e.g. including floor plates, but may also be formed by a drill floor frame member on top of or onto which floor plates or the like are to be mounted, e.g. at a later stage.

It is noted that one can also envisage a system wherein the base units themselves have no drill floor member embodying the drill floor (or part thereof) or supporting the drill floor plates in operational position of the rig, but instead the drill floor member as discussed herein as part of the base unit is substituted for a beam or frame that constitutes a mobile bar member of the four-bar-linkage mechanism. The drill floor member is then no part of the base unit, and is possibly installed later in the mast. For example drill floor members that are to present on opposite side on the outside of the mast, above the base units, are hoisted onto the mast after it has been erected or one or more drill floor members form part of a mast section, e.g. as hinged flaps that can be deployed into operative position.

According to an embodiment of the invention, the foot of the drilling rig mast is to be connected pivotally to a base member, e.g. to a well base member or plate. As is preferred this pivot axis coincides with or forms a pivot axis of the four-bar-linkage mechanism.

Possibly, a guide mechanism is provided to enable the foot of the drilling rig mast to become aligned properly with a pivot assembly of the base structure to allow their connection.

In an embodiment, the foot of the drilling mast comprises a mast connection point or member to be connected pivotally to a base structure connection point or pivot structure. These mast connection point and mating connection point have to be brought in line to be able to establish the connection. A guide mechanism can guide the mast connection point to the mating connection point.

Possibly the guide mechanism comprises a pivotable guide rod, one end of which is connected pivotable to a base member and the other end of which can grab and guide the foot of the drilling rig mast. Actuating means may be provided to actuate this guiding of the foot of the drilling rig mast. The actuating means may be a separate hydraulic cylinder, but it is also conceivable that the drive assembly of the mast and the drill floor is also used to enable the foot of the mast to be connected with the base plate.

The drive assembly to raise and lower the mast and the drill floor may include a winch, e.g. a hydraulic winch having one or more hydraulic winch drive motors, and one or more and cables. Alternatively, a hydraulic cylinder may be provided as drive assembly integrated into the base unit and engaging on the floor member or a beam of the linkage mechanism.

In an embodiment the drive assembly of the base unit is provided with a drum type winch, having a drum onto which a cable is wound.

In order to multiply the force exerted by the winch, the cable is preferably passed in a multi-fall arrangement between a first set of sheaves that is connected to the base member and a second set of sheaves connected to a mobile part of the bar-linkage member, for example to the upper end of a pivotal beam, for example such as to have the rotation axis of the sheaves of the second set coincide with the pivot axis between the beam and the drill floor member.

A hydraulic power unit including a pump and hydraulic reservoir may be integrated into the unit to provide hydraulic power to the winch and/or other hydraulic actuators of the base unit.

In a preferred embodiment the winch has one or more hydraulic drive motors and the base unit is provided with a hydraulic power unit including a pump and a reservoir for hydraulic fluid, more preferably the pump having an electric pump motor and the base unit being provided with a fuel powered generator providing electricity for the pump motor and possibly electrical control of the hydraulic system. It is envisaged that in order to obtain a redundant structure for electrical power in the base units of a rig, the generator of one base unit can also be connected to provide electrical power to the other base unit, so that even in case of failure of one generator the base units remain functional.

The base unit may, in addition to a hydraulic winch, include more hydraulic actuators, e.g. a drill floor member actuator as explained herein, and possibly one or more other hydraulic actuators for other additional functions, e.g. moving a floor plate of the drill floor, etc. A control for the hydraulic system can e.g. be embodied for remote control, e.g. an operator carrying a control box as is known in the field of cranes.

To enhance the compactness of the base unit for its transportation, in particular in view of the height of the base unit, yet to allow for an effective application of the winch force in particular when raising the mast from its horizontal position, the set of sheaves connected to the base member of the base unit are preferably arranged so as to be mobile relative to the base member between a transportation position and an operative position, preferably said operative position being higher relative to the base member than the transportation position. The mobile arrangement of the first set of sheaves is primarily embodied such that the displacement to its operative position of the first set of sheaves increases the angle between the one or more pivotal beams and the cable—with the beam or beams still in transportation position. The increased angle of the cable causes an increase of effective momentum caused by the pulling of the winch to raise the drill floor member and mast. This in turn allows for a weight reduction of the base unit, which facilitates its handling and transportation, e.g. as the internal forces within the base unit are also reduced by the increased angle of the cable.

In a preferred embodiment the first set of sheaves is mounted on a mobile carrier that is mobile mounted on the base member of the base unit. It is further preferred that in addition to the first set of sheaves the winch is mounted on the carrier, so as to form a common mobile carrier. In an embodiment the mobile carrier is pivotally mounted on the base member so as to be pivotal between the transportation position and the raised operative position.

As to the height reduction it is envisaged, in a preferred embodiment, that the base unit is embodied to be dimensioned as an ISO freight container, e.g. having a (maximum) height of 8 feet. This constraint, in view of the preceding paragraph, can best be met by providing the first set of sheaves and its carrier in a mobile manner in the base unit.

A mobile carrier drive motor, e.g. a hydraulic cylinder, is preferably integrated in the base unit to perform the motion of the carrier relative to the base. As explained a hydraulic drive motor for this purpose may form part of an integrated hydraulic system of the base unit.

As is preferred a locking arrangement, e.g. with one or more locking pins, is provided to lock the carrier in its operative position.

Instead of a pivotal arrangement of the carrier the mobile mounting could also include a sliding arrangement, e.g. along an upward guide, e.g. inclined or vertical, to cause the raising of the first set of sheaves to their operative position.

In a preferred embodiment the base structure comprises a well base member adapted to be positioned on the ground adjacent the well centre and two of said transportable base units, which base units are each connectable to the well base member, e.g. in a C-arrangement when seen from above, such that said base units extend side-by-side with a spacing there between dimensioned to receive a lower portion of the drilling mast in its substantially horizontal position, and wherein the drilling mast is connectable to the floor member and/or a beam of the linkage-bar mechanism of both of said base units such that by simultaneous operating the drive assemblies of both of said base units the drill floor members are moved between the lowered and elevated position and simultaneously the drilling mast—when connected to the floor member and for the bar-linkage mechanism—is moved between its substantially horizontal position and the vertical operating position thereof.

In an embodiment the foot of the mast is pivotally connectable to a pivot structure provided on the well base member, said drilling mast being pivoted about said pivot structure when being moved between its substantially horizontal position and the vertical operating position.

In an embodiment each base unit is elongated. e.g. 40 foot long as an ISO freight container, and has an axial end face, and wherein the well base member has a side that is provided with two sets of connector members each for connecting the well base to an axial end face of a base units.

In an embodiment each bar-linkage mechanism is embodied as a four-bar-linkage mechanism having two beams and four parallel pivot axes, two lower pivot axis at the connection of the beams with the base member and two upper pivot axis at the connection of the beams with a drill floor member.

In an embodiment the foot of the mast is connectable to the base structure so as pivot the drilling mast about an axis which coincides with a lower pivot axis of said bar-linkage mechanism of said one or two base units. In an embodiment the drilling mast is additionally connectable via one or more connector members to the four-bar linkage member or the drill floor member at a location which coincides with the upper pivot axis of the same beam of which the lower pivot axis coincides with the pivot for the foot of the mast.

In an embodiment the drive assembly integrated into a base unit comprises a winch, e.g. a hydraulic power winch, and a cable connected to said winch. In an embodiment the winch is mounted on the base member of the base unit, and wherein a first set of one or more sheaves is mounted on the base member and a second set of sheaves on the linkage-bar mechanism or the drill floor member, said cable being passed from said winch over said first and second sets of sheaves so as to obtain a multiple fall cable arrangement.

In an embodiment the base unit is provided with a locking mechanism that is adapted to lock the bar-linkage mechanism in its raised position.

In an embodiment the locking mechanism comprises a locking bar that extends substantially diagonally between the beams of the bar-linkage mechanism in raised position thereof. In an embodiment a lower end of the locking bar is pivotally connected to the base member and wherein an upper end of the locking bar is associated with a latch connecting the upper end to a part of the bar-linkage mechanism or drill floor in raised position of the bar-linkage mechanism, e.g. locking automatically when said position is reached.

In an embodiment the locking bar is provided with a damper, e.g. a hydraulic damper, to dampen motion of the drill floor and drilling mast when reaching their elevated and vertical operational position respectively.

In an embodiment the system comprises a guide mechanism to guide the foot of the substantially horizontal mast, e.g. lying on a trailer, to a pivot structure of the base structure, the drilling mast being pivotal about said pivot structure when being moved between its horizontal and its vertical operation position, e.g. the guide mechanism raising said foot from its original height when lying on the trailer.

In an embodiment the drilling mast is composed of multiple transportable mast sections that are assembled end-to-end, said sections at least including a foot or lower section forming the foot of the mast and a top section forming the top of the mast, and wherein the drive assembly of the one or more base units are adapted to move the mast assembled from said mast sections in substantially horizontal orientation from said horizontal position to its vertical operational position simultaneous with the raising of the drill floor member or members.

In an embodiment the drilling mast is provided with a hoist device adapted to hoist drilling drawworks—with the mast in its vertical operational position—to an elevated drawworks position on the mast, and wherein the drilling mast is provided with drawworks connection members adapted to connect the drawworks to the drilling mast at said elevated drawworks position, preferably spaced above the drill floor.

As indicated above, in an advantageous modular drilling rig according to the invention the drawworks are no longer positioned on the ground in the drilling area, but are connected to the drilling mast in an elevated drawworks position. In such a possible embodiment, the drilling rig mast is provided with hoist means to hoist drilling drawworks to an elevated drawworks position, and the drilling rig mast is provided with drawworks connection means to connect the drawworks to the drilling mast in the elevated drawworks position. In particular, the drilling mast hoist means may comprise a crane provided at the upper end of the drilling rig mast and an auxiliary jib provided adjacent the elevated drawworks position, in which auxiliary jib.

The present invention also relates to a modular transfigurable drilling rig system composed of multiple components, which system is transfigurable between a transport mode in which the components of the system are transportable and an operational mode in which the components are assembled to a drilling rig which is adapted to drill into a well centre in the ground, the system comprising:

a base structure adapted to be positioned in the operational mode on the ground near a well centre, which base structure comprises:

one or more base members, e.g. base plates. adapted to be positioned on the ground, one or more drill floor members adapted to form a drill floor in the operational mode, said drilling floor in the operational mode being located at an elevated position above said one or more base members and the well centre, at least one bar-linkage mechanism comprising one or more beams that extend between a base member and a drill floor member, said one or more beams being pivotally connected to said base member and said drill floor member, which bar-linkage mechanism is operable to move between a transport position in which the drill floor member is in a lowered position relatively close to the base member, and in which transport position preferably said one or more beams of the bar-linkage mechanism are substantially parallel to the base member, and a raised position in which the drill floor member is in its elevated position, a drilling rig mast which is movable between a substantially horizontal assembly position, wherein the mast is assembled by interconnection multiple mast sections, and an operational position vertically above the well centre, the drilling rig mast having a top end and a foot, at least one drive assembly to move the one or more drill floor members and the mast between the lowered and elevated position and the substantially horizontal position and the vertical operational position respectively, characterized in that the rig system comprises two base transportable base units to be placed on the ground in side-by-side arrangement with a space between them, in that each base unit is embodied to have:

a) a base member and two pivotal beams, each connected at a lower end thereof to the base member of the base unit about a first and second lower pivot axis respectively and each connected at an upper end thereof to a drill floor member about a first and second upper pivot axis respectively, such that said base member, pivotal beams and drill floor member form a four-bar-linkage mechanism, or b) a base member and a single pivotal beam, connected at a lower end thereof to the base member of the base unit about a first lower pivot axis and connected at the upper end thereof to a drill floor member about a first upper pivot axis, wherein a foot of the mast is pivotally connectable to the base structure so as to pivot about a second lower pivot axis and the drill floor member is pivotally connectable to the mast to pivot about a second upper pivot axis, such that said base member, pivotal beam, drill floor member, and mast from the four-bar-linkage member, and in that the drilling mast is with its lower section in substantially horizontal position arrangeable between the base units and connectable to the base structure and to the four-bat-linkage mechanism of each transportable base unit, and in that each base unit is provided with an integrated drive assembly that is embodied to move the drill floor member between the lowered and elevated position and simultaneously move the drilling mast—connected to the floor member and/or the bar-linkage mechanism—between its substantially horizontal position and the vertical operating position thereof.

It will be appreciated that the system defined above may if desired have one or more of the technical features discussed with reference to the system of claim 1.

The present invention also envisages an embodiment wherein the system further comprises a pipe loader, and wherein—after the mast has been brought into its vertical operative position—the pipe loader can be arranged to extend at least partly in the space between the side-by-side base units, preferably said pipe loader interconnecting the base units.

The present invention also relates to a method for bringing into operational mode a modular transfigurable drilling rig system according to the invention, said method comprising the steps of:

positioning said at least one transportable base unit on the ground;

positioning, possibly assembling, the drilling rig mast in substantially horizontal position and connecting said mast to the drill floor member and/or bar-linkage mechanism of said at least one base unit;

operating the at least one drive assembly of the at least one base unit such that the at least one drill floor member moves to its elevated position and the drilling mast simultaneously moves to its vertical operational position.

The present invention also relates to a transportable base unit as described herein for use in a drilling rig system, e.g. in a drilling rig system according to the invention.

The invention also relates to a modular transfigurable drilling rig system composed of multiple components, which system is transfigurable between a transport mode in which the components of the system are transportable and an operational mode in which the components are assembled to a drilling rig which is adapted to drill into a well entre in the ground, the system comprising:

a base structure adapted to be positioned in the operational mode on the ground, a drilling rig mast which is movable between a substantially horizontal position and a vertical operational position, at least one drive assembly to move the mast between the substantially horizontal position and the vertical operational position respectively, characterized in that the drilling mast is provided with a hoist device adapted to hoist drilling drawworks—with the mast in its vertical operational position—to an elevated drawworks position on the mast, and wherein the drilling mast is provided with drawworks connection members adapted to connect the drawworks to the drilling mast at said elevated drawworks position, preferably spaced above the elevated drill floor.

The invention also relates to a method for bringing the modular transfigurable drilling rig system as above in operational mode, the method comprising the steps of:

positioning said base structure on the ground;

positioning, possibly assembling, the drilling rig mast in substantially horizontal position;

operating the at least one drive assembly such that the drilling mast moves to its vertical operational position;

hoisting the drawworks to the elevated drawworks position;

connecting the drawworks to the drilling mast in the elevated drawworks position.

The invention also relates to a method for bringing a modular transfigurable drilling rig system into an operational mode, wherein the modular transfigurable drilling rig system is composed of multiple components, which system is transfigurable between a transport mode in which the components of the system are transportable and an operational mode in which the components are assembled to a drilling rig which is adapted to drill into a well centre in the ground, the system comprising:

a base structure adapted to be positioned on the ground, a drilling rig mast which is connectable to the base structure and is movable between a substantially horizontal mast assembly position and an operational position vertically above the well centre, the drilling rig mast having a top end and a foot, a top drive to perform drilling activities, at least one drive assembly to move the drilling rig mast between said horizontal and vertical position relative to the base structure, wherein the method comprises the steps of:

positioning said base structure on the ground;

assembling the drilling rig mast in a substantially horizontal position and connecting the foot of the drilling mast to the base structure;

supplying by means of a vehicle the top drive in a substantially horizontal orientation, aligning the drilling rig mast, in at least partly assembled state and connected to the base structure, with the top drive that is in substantially horizontal orientation on the vehicle, when aligned, connecting the top drive to the drilling rig mast;

operating the at least one drive assembly such that the drilling mast with the top drive moves towards its vertical operational position.

The invention also envisages that the drilling rig mast is composed of multiple sections at least including a lower mast section, middle mast section, and an upper mast section, and wherein the method for assembly of the rig comprises the steps of:

connecting the lower mast section to the base structure, connecting the middle mast section to the lower mast section in a substantially horizontal assembly position, aligning the middle section with the top drive that is in substantially horizontal orientation on the vehicle when aligned, connecting the top drive to the drilling rig mast middle section;

connecting said upper mast section to the one or more middle sections in substantially horizontal assembly position, operating the at least one drive assembly such that the drilling mast with the top drive moves towards its vertical operational position.

The invention also envisages that the mast comprises a top section including a crown block and a travelling block, and wherein—after bringing the mast in its vertical operational position —the travelling block is connected to the top drive.

The invention also envisages a method for bringing a modular transfigurable drilling rig system into an operational mode, wherein the modular transfigurable drilling rig system is composed of multiple components, which system is transfigurable between a transport mode in which the components of the system are transportable and an operational mode in which the components are assembled to a drilling rig which is adapted to drill into a well centre in the ground, the system comprising:

a base structure adapted to be positioned in the operational mode on the ground, a drilling rig mast composed of multiple sections, which is movable between a substantially horizontal mast assembly position and an operational position vertically above the well centre, the drilling rig mast having a top end and a foot, at least one drive assembly to move the drilling rig mast between the substantially horizontal mast assembly position and the vertical operational position, wherein the method comprises the steps of positioning said base structure on the ground;

positioning a lower mast section on a vehicle adjacent the base structure;

connecting a foot end of the lower mast section to the base structure;

positioning a subsequent drilling rig mast section on a vehicle in a substantially horizontal position adjacent the lower mast section;

connecting one end of the subsequent drilling mast section to the lower mast section; operating the at least one drive assembly such that the mast moves towards its vertical operational position.

It is noted that whilst the rig of the invention is primarily proposed for land based drilling activities, e.g. oil, gas (e.g. shale gas), geothermal drilling activities, the same rig may also be employed for drilling offshore. The ground is then formed by a platform, drilling vessel, etc.

The invention is further described in the claims and explained here below in relation to the drawings, in which:

Figure 16:
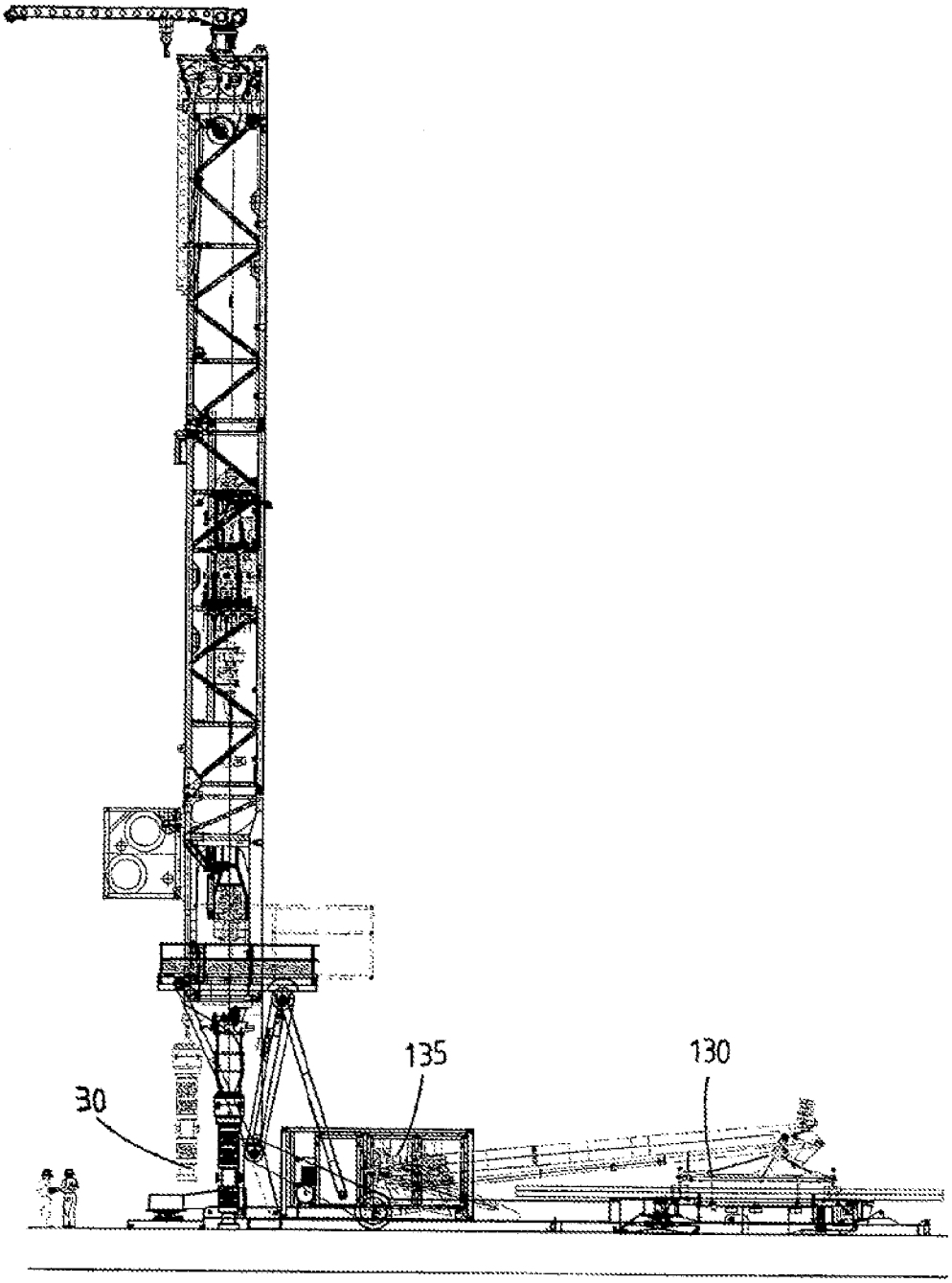
Figure 17:
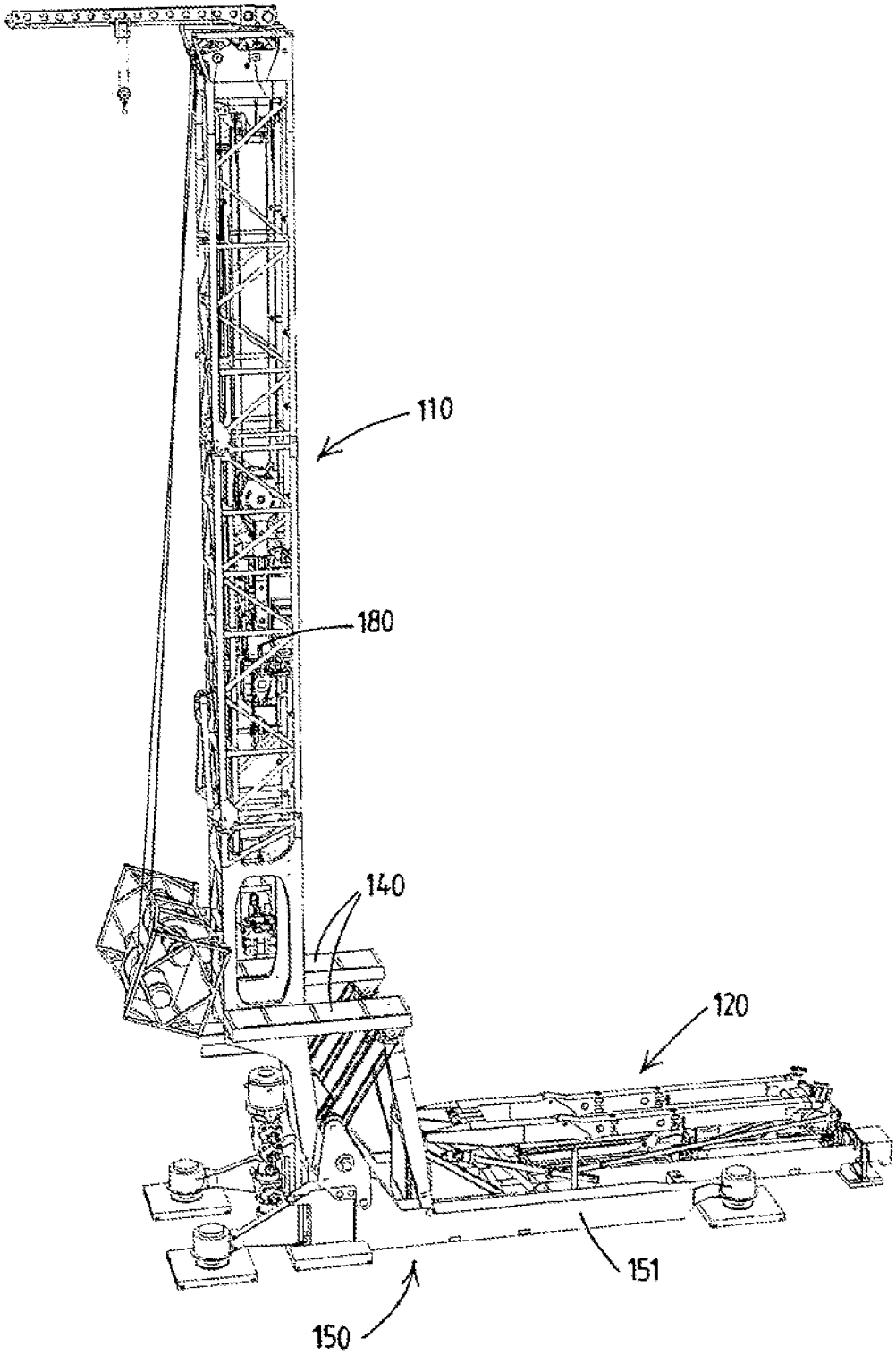
Figure 18:
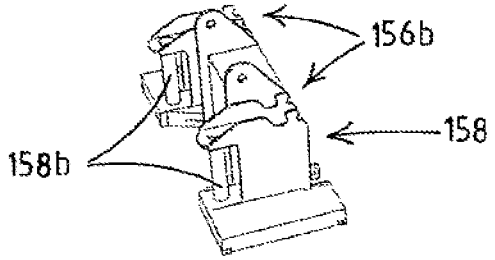
Figure 19:
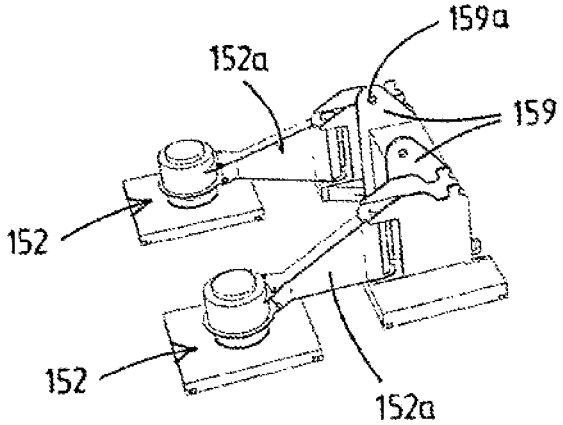
Figure 20:
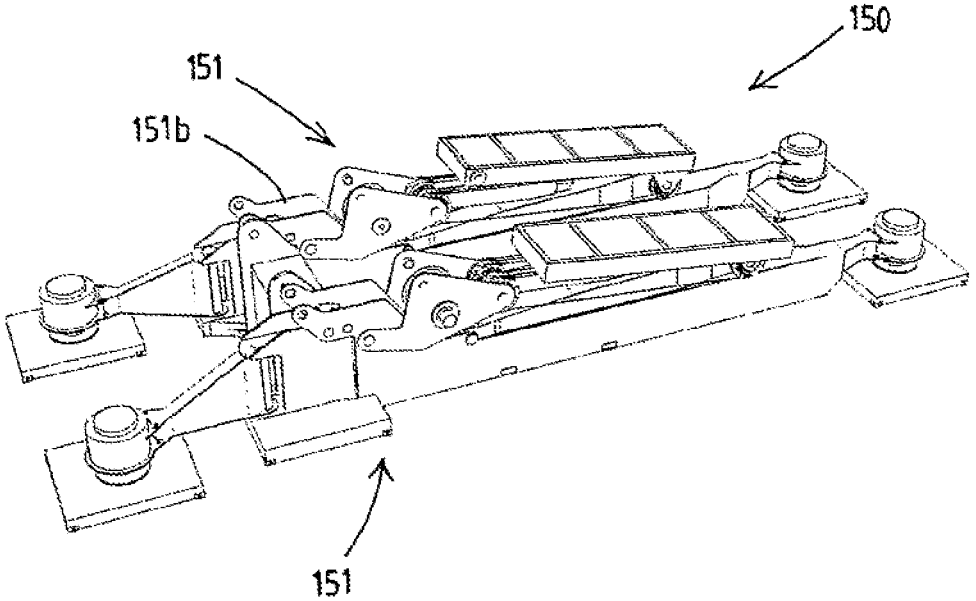
Figure 21:
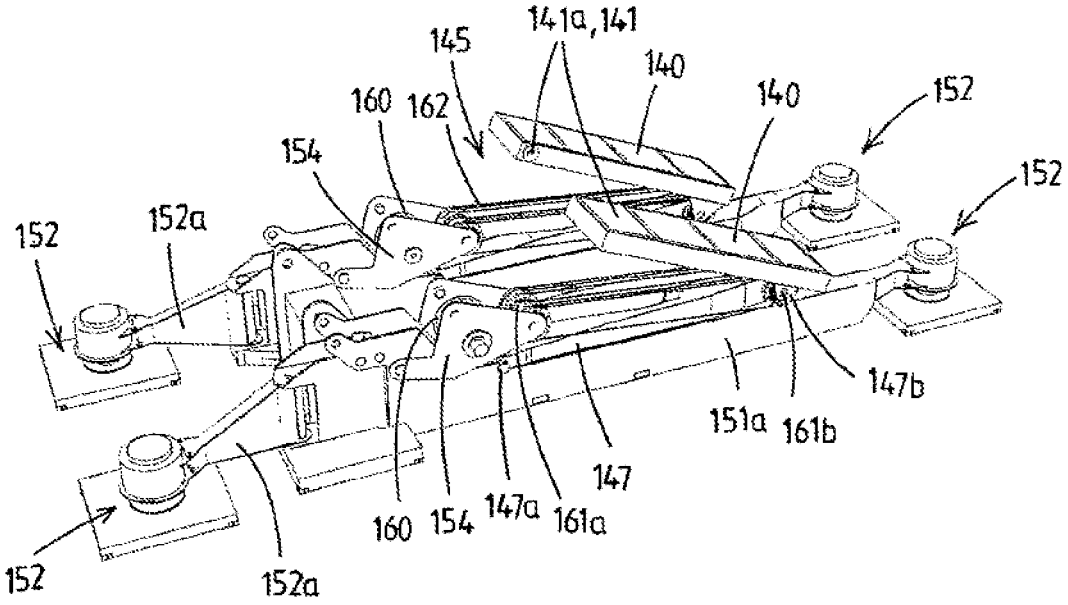
Figure 22:
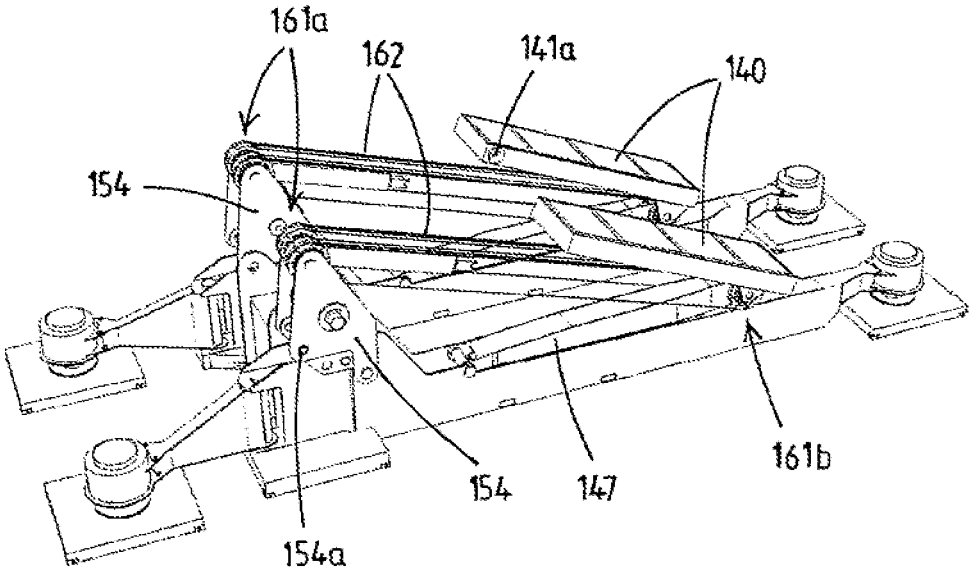
Figure 23:
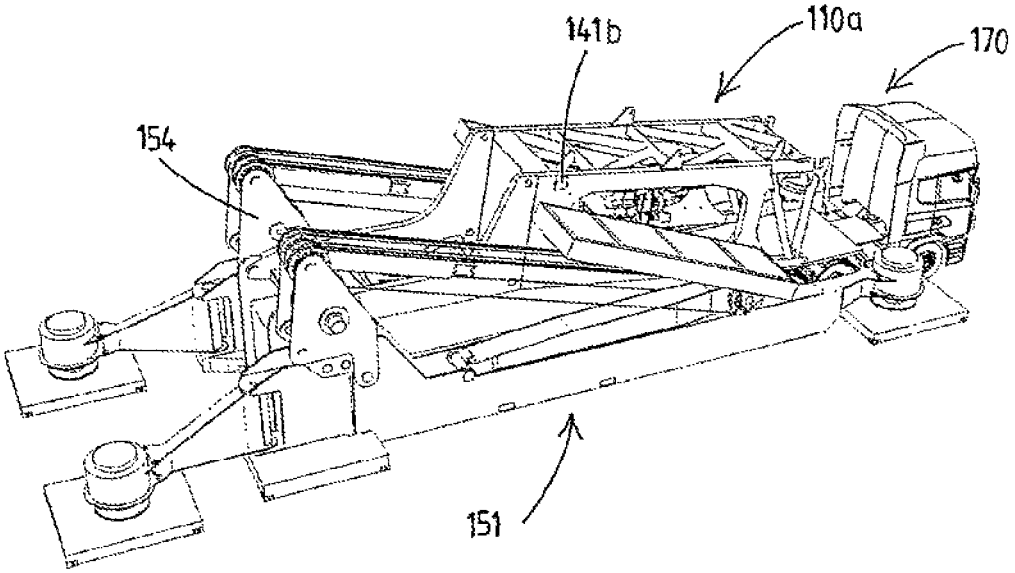
Figure 24:
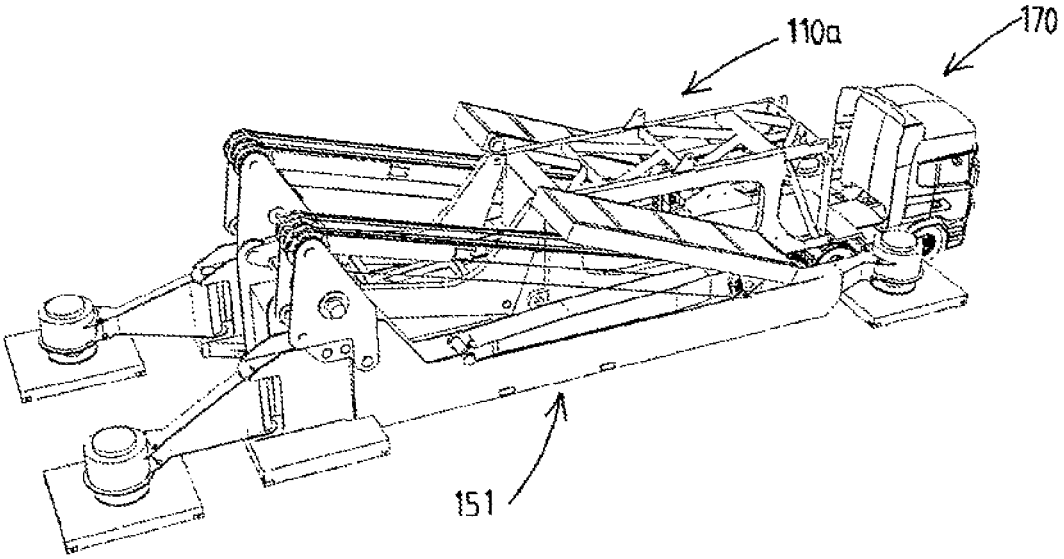
Figure 25:
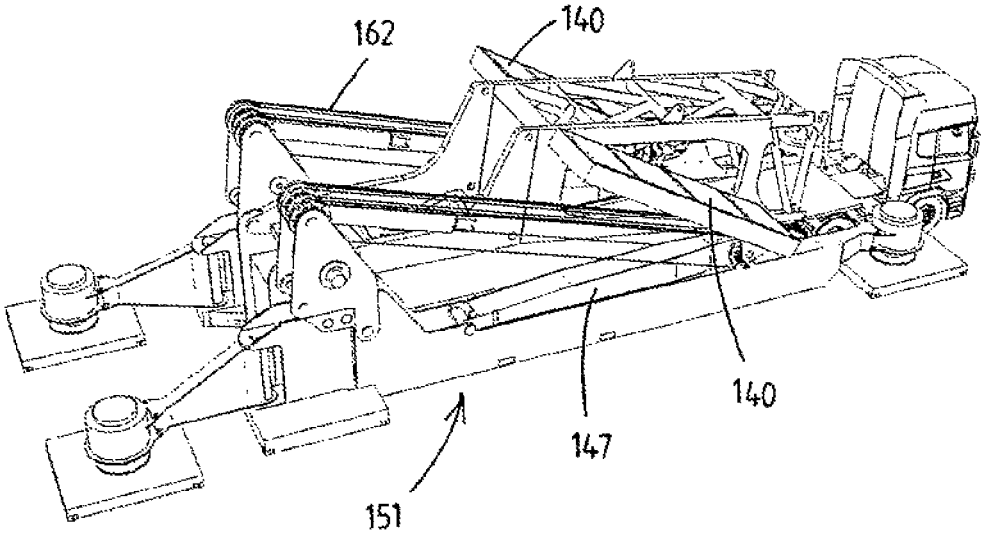
Figure 26:
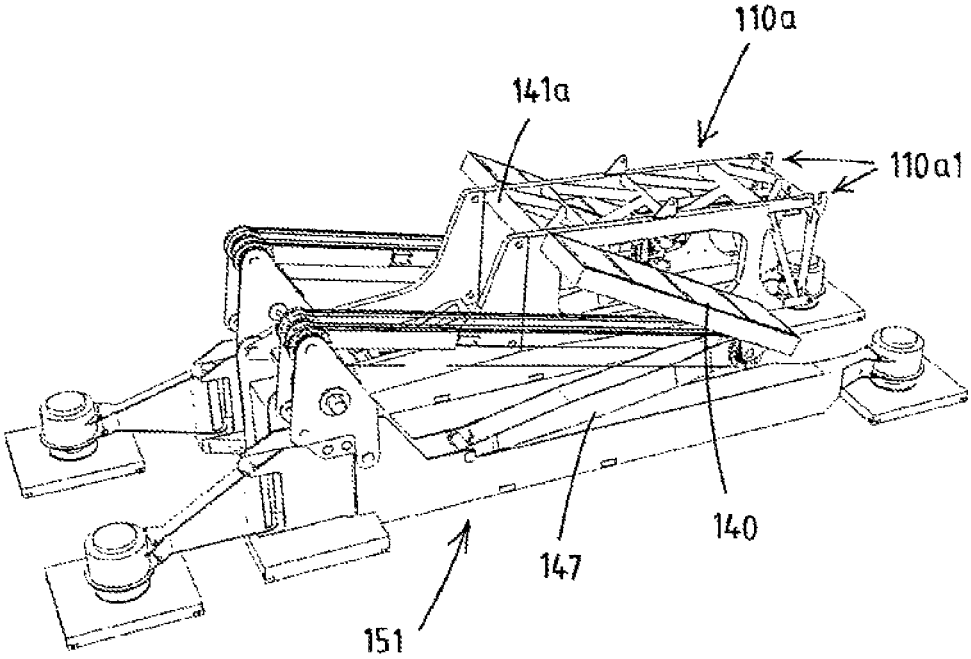
Figure 27:
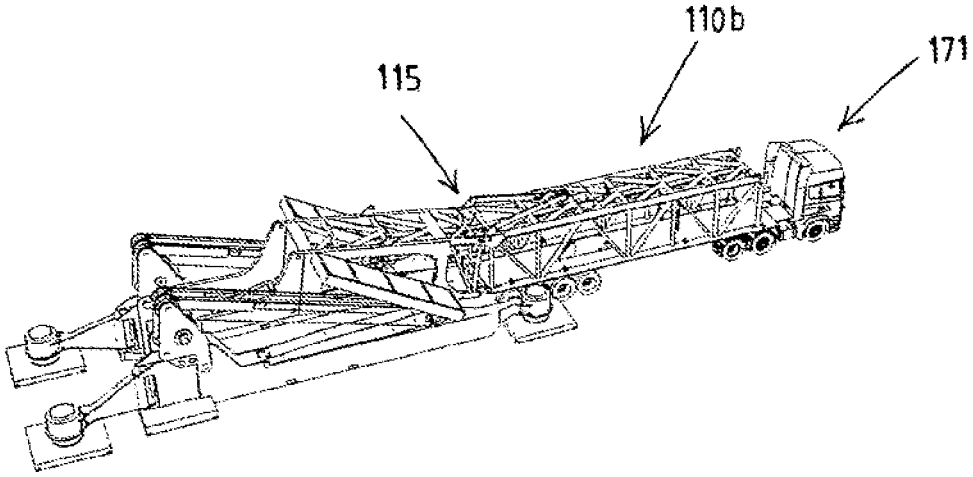
Figure 28:
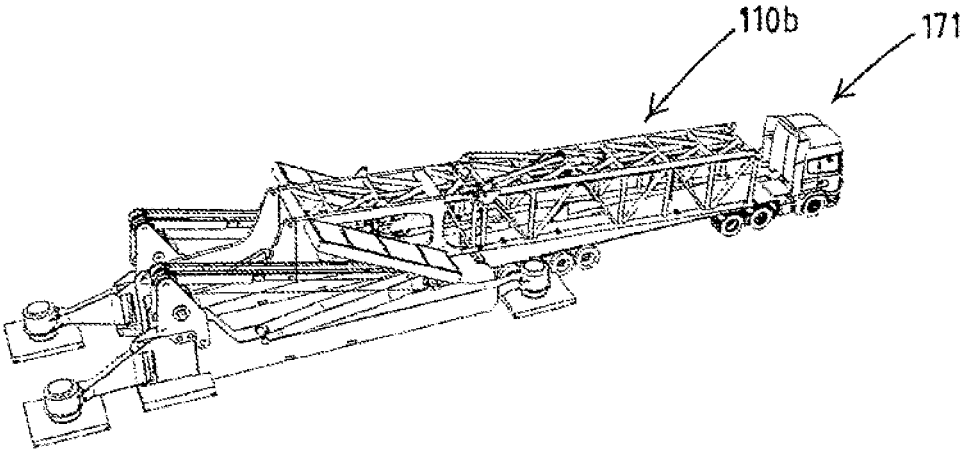
Figure 29:
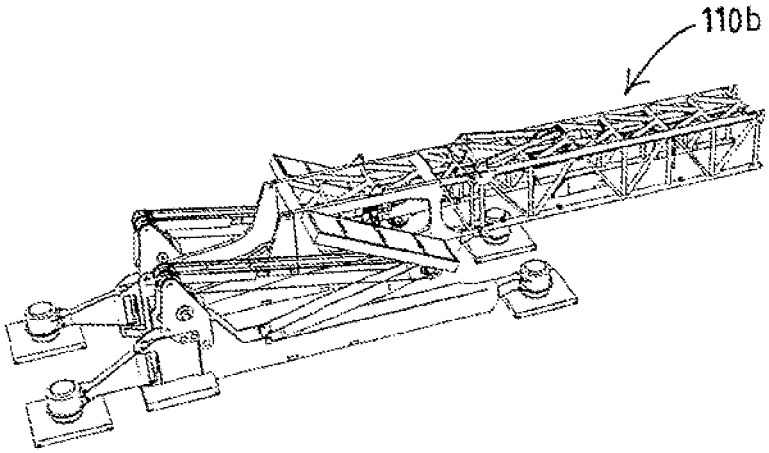
Figure 30:
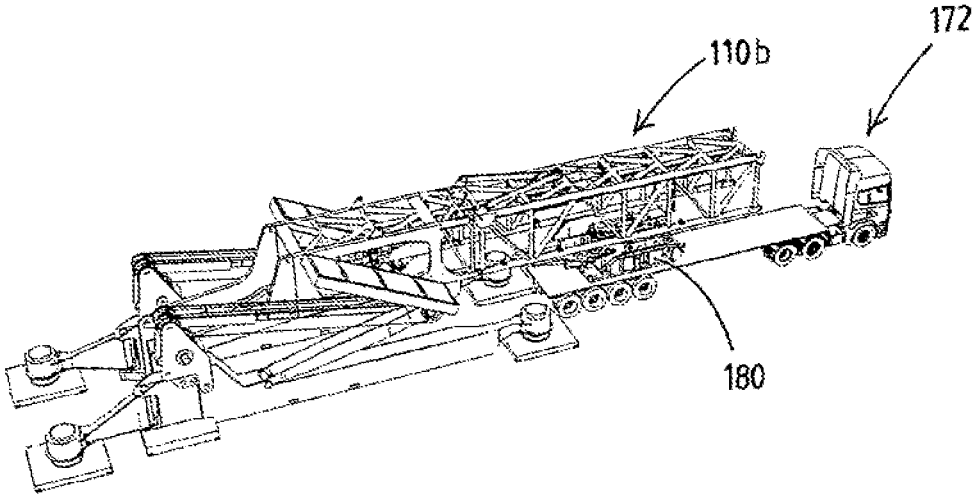
Figure 31:
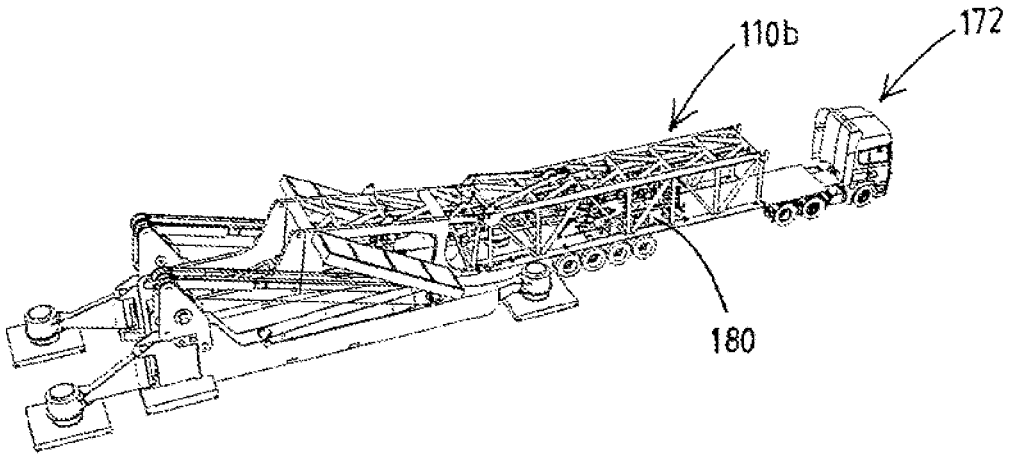
Figure 32:
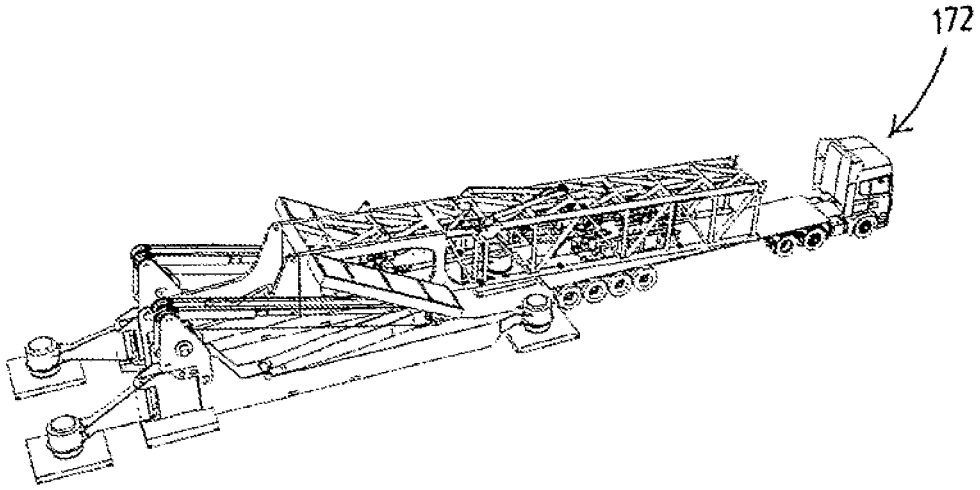
Figure 33:
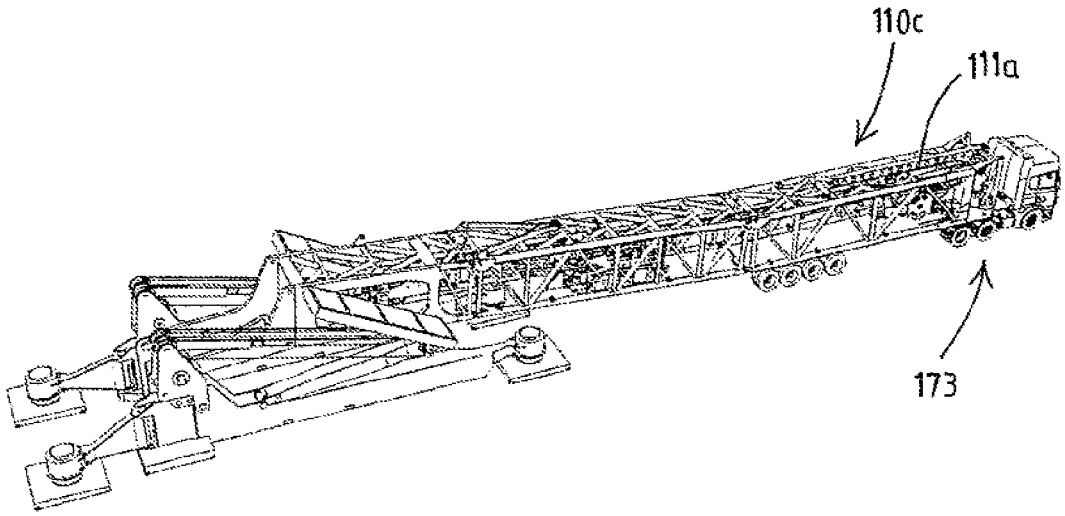
Figure 34:
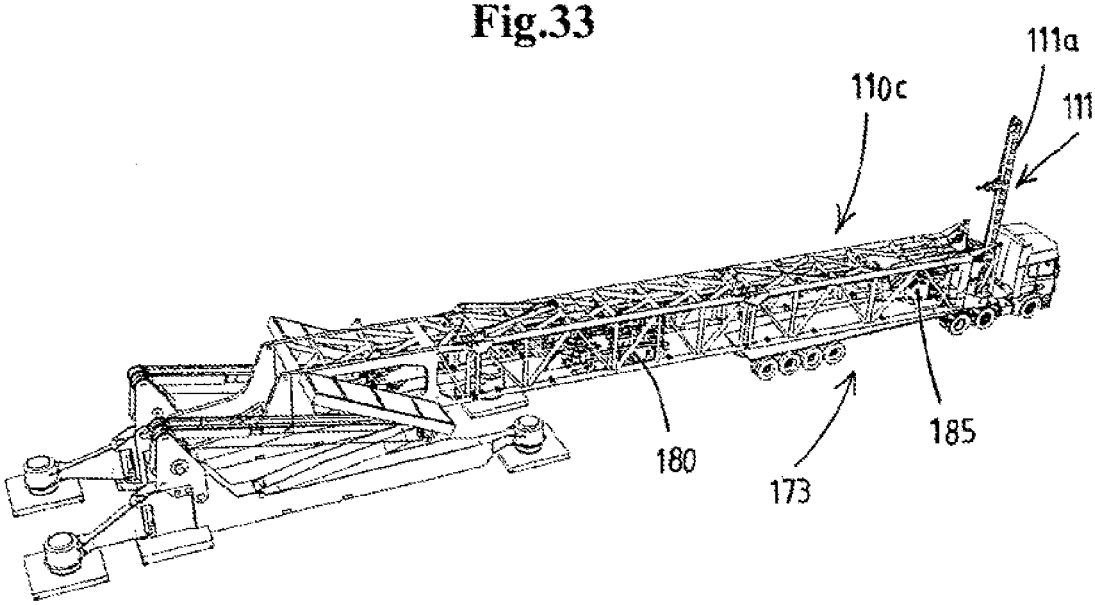
Figure 35:
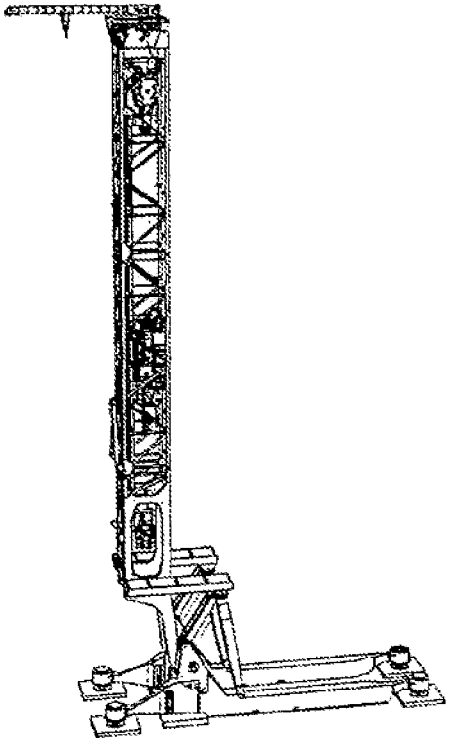
Figure 36B:
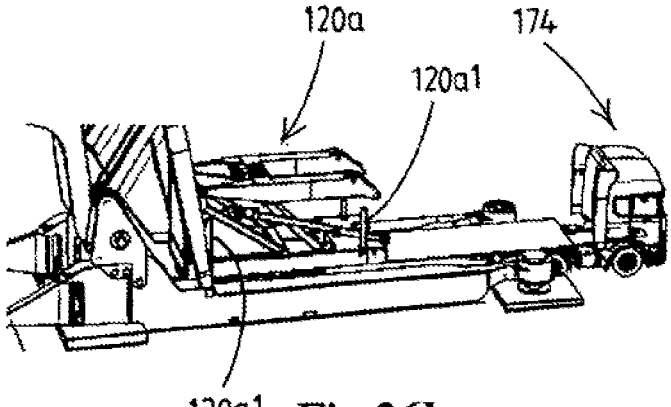
Figure 36A:
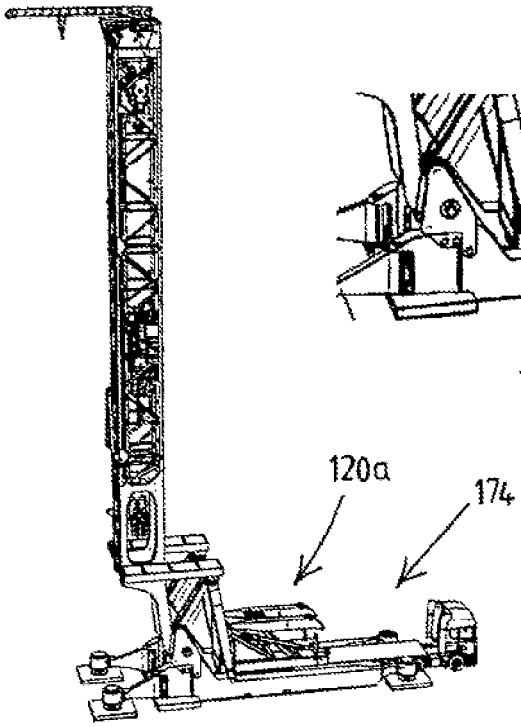
Figure 37A:
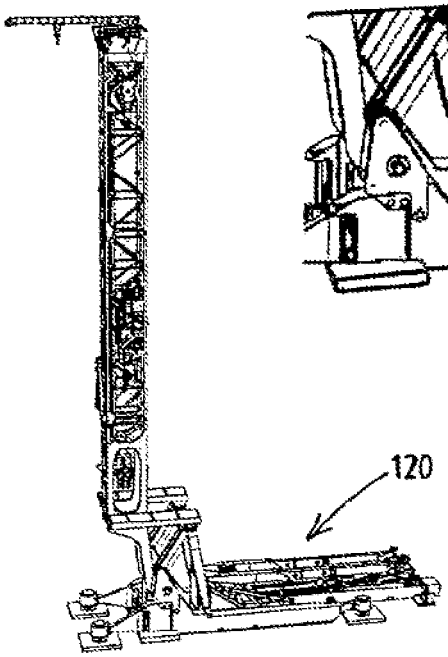
Figure 38:
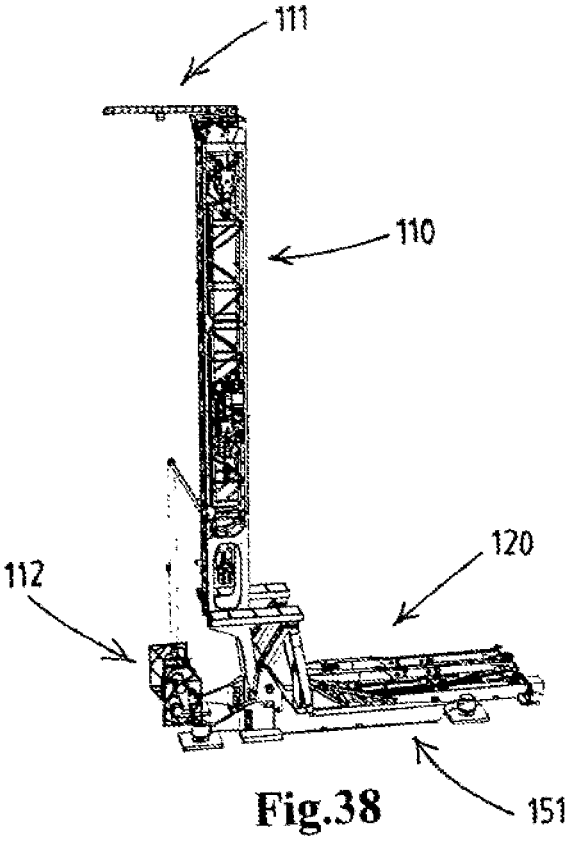
Figure 39:
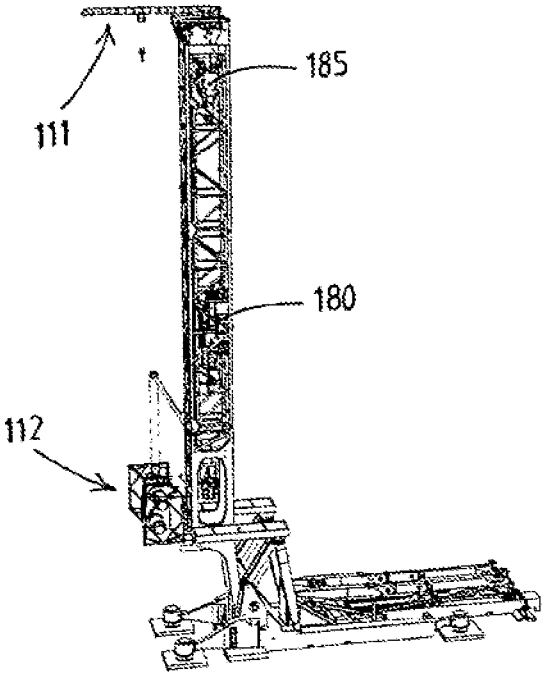
Figure 40:
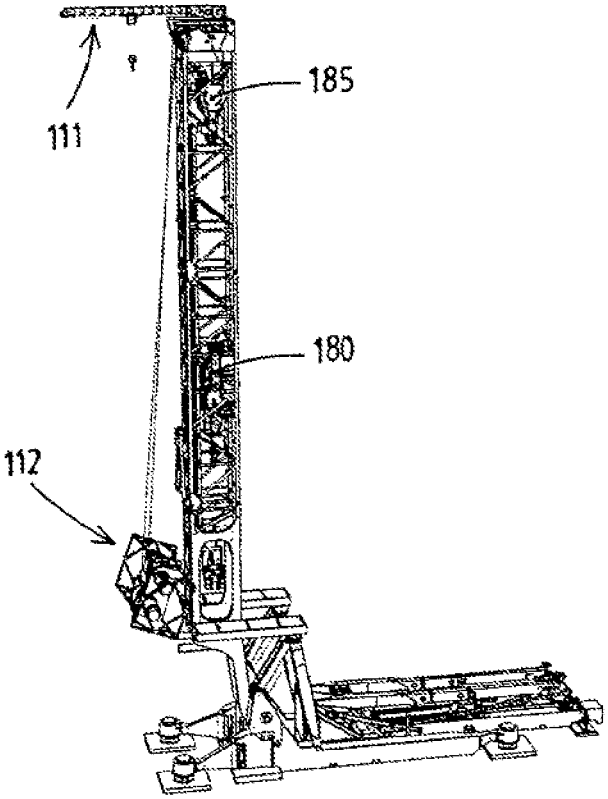
Figure 41:
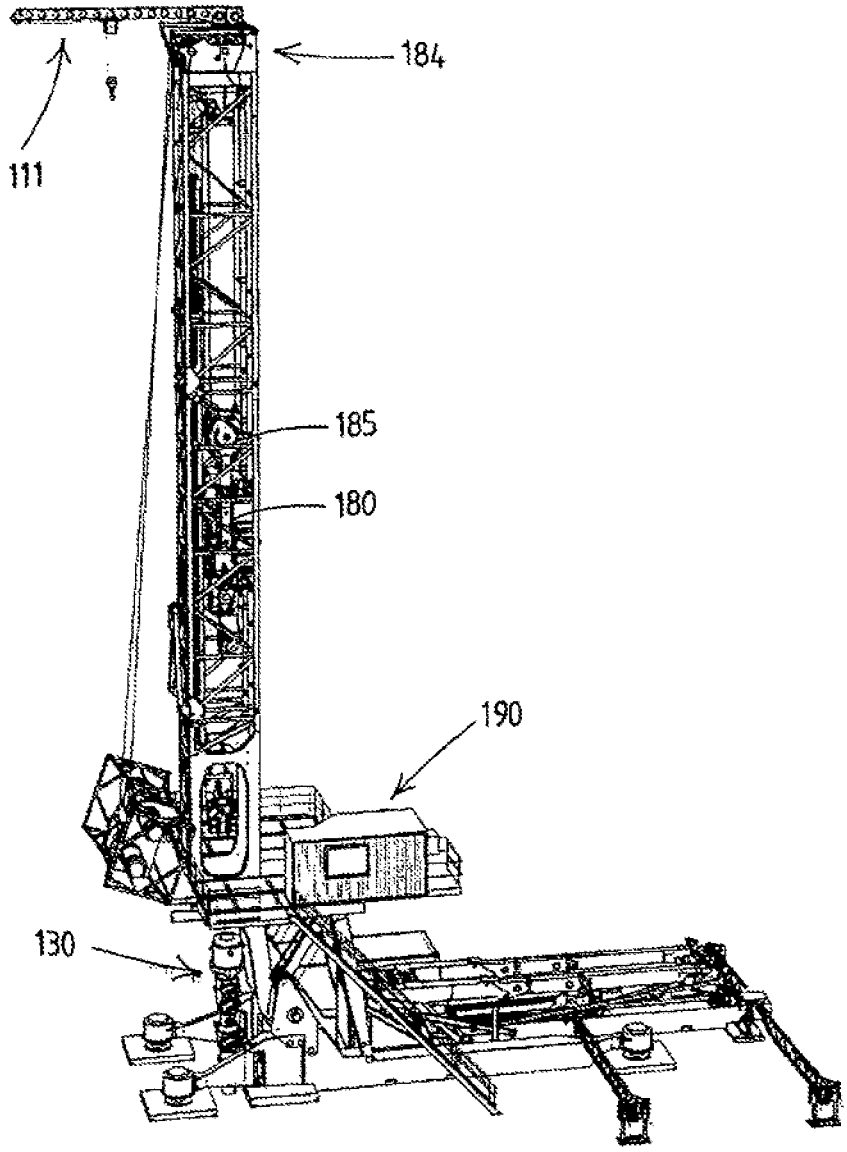
Figure 42:
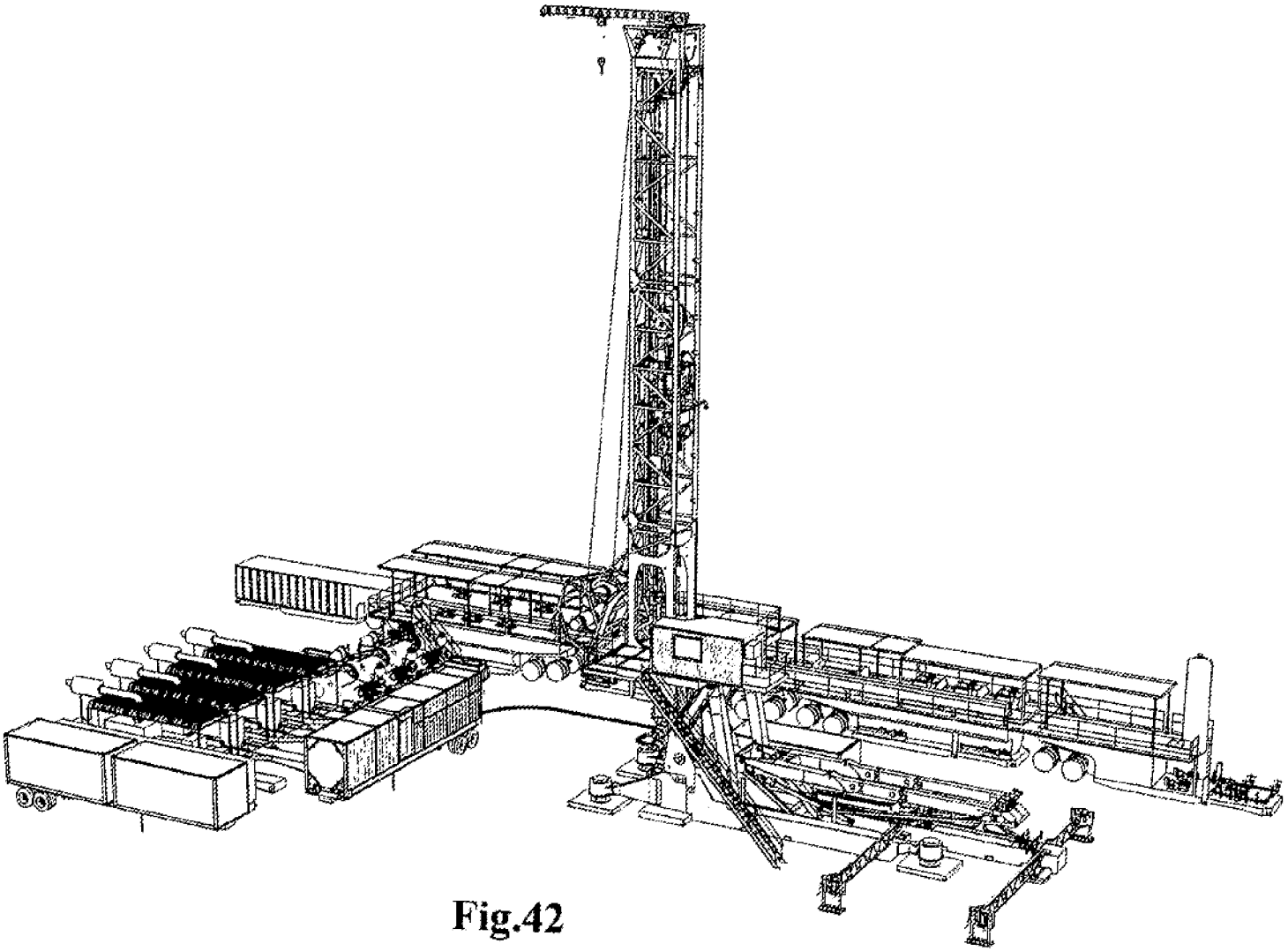

FIGS. 4-16 show in a side view and in sequential steps a modular drilling rig according to the present invention which is transfigured from a transport position to an operational position, FIG. 17 shows in perspective view another embodiment of a modular drilling rig according to the present invention in an operational position, FIG. 18 shows the well base member of the rig of FIG. 17, FIG. 19 shows the well base member and interconnected feet of the rig of FIG. 17, FIG. 20 shows the base structure of the rig of FIG. 17 placed on the ground, FIG. 21 shows the base structure of FIG. 20 with the drill floor members raised from their transportation position, FIG. 22 shows the base structure of FIG. 21 with the carriers in raised position, FIG. 23 shows the base structure of FIG. 22 with the lower mast section supplied on a transport vehicle and moved between the base units and connected to the well base member, FIG. 24 shows the elements of FIG. 23 with the lower mast section straightened, FIG. 25 shows the elements of FIG. 24 with the mast section straightened, FIG. 26 shows the linkage mechanism and drill floor slightly raised, with the vehicle departed and allowing for connecting of subsequent mast sections, FIG. 27 shows the supply of a further mast section by a vehicle generally aligned with the lower mast section FIGS. 28, 29 shows the lifting of the further mast section from the vehicle using the base structure drive assembly and keeping the mast as it is in generally horizontal position, FIG. 30 shows the supply of the top drive lying on a vehicle underneath the mast that is held in generally horizontal position, FIG. 31 shows the lowering of the mast so as to position the top drive still lying on the vehicle to be within the mast and allowing for connecting the top drive to the mast, FIG. 32 shows the lifting of the mast with the top drive connected thereto from the vehicle allowing said vehicle to depart, FIG. 33 shows supply of yet another mast section on a vehicle and connection thereof to the mast, FIG. 34 shows the lifting of the mast from the vehicle allowing said vehicle to depart, FIG. 35 shows the rig with the mast in vertical operating position, FIG. 36 *a,b* show the supply of a first part of the pipe loader on a vehicle so as to be placed between the base units of the base structure, FIG. 37*a,b* show the rig of FIG. 36 with the second part of the pipe loader connected to the first part, FIGS. 38-40 show the lifting of the drawworks into the mast, FIG. 41 shows the rig in operative state FIG. 42 shows the rig in operative state with associated equipment such a mud handling, etc.

Figure 1A:
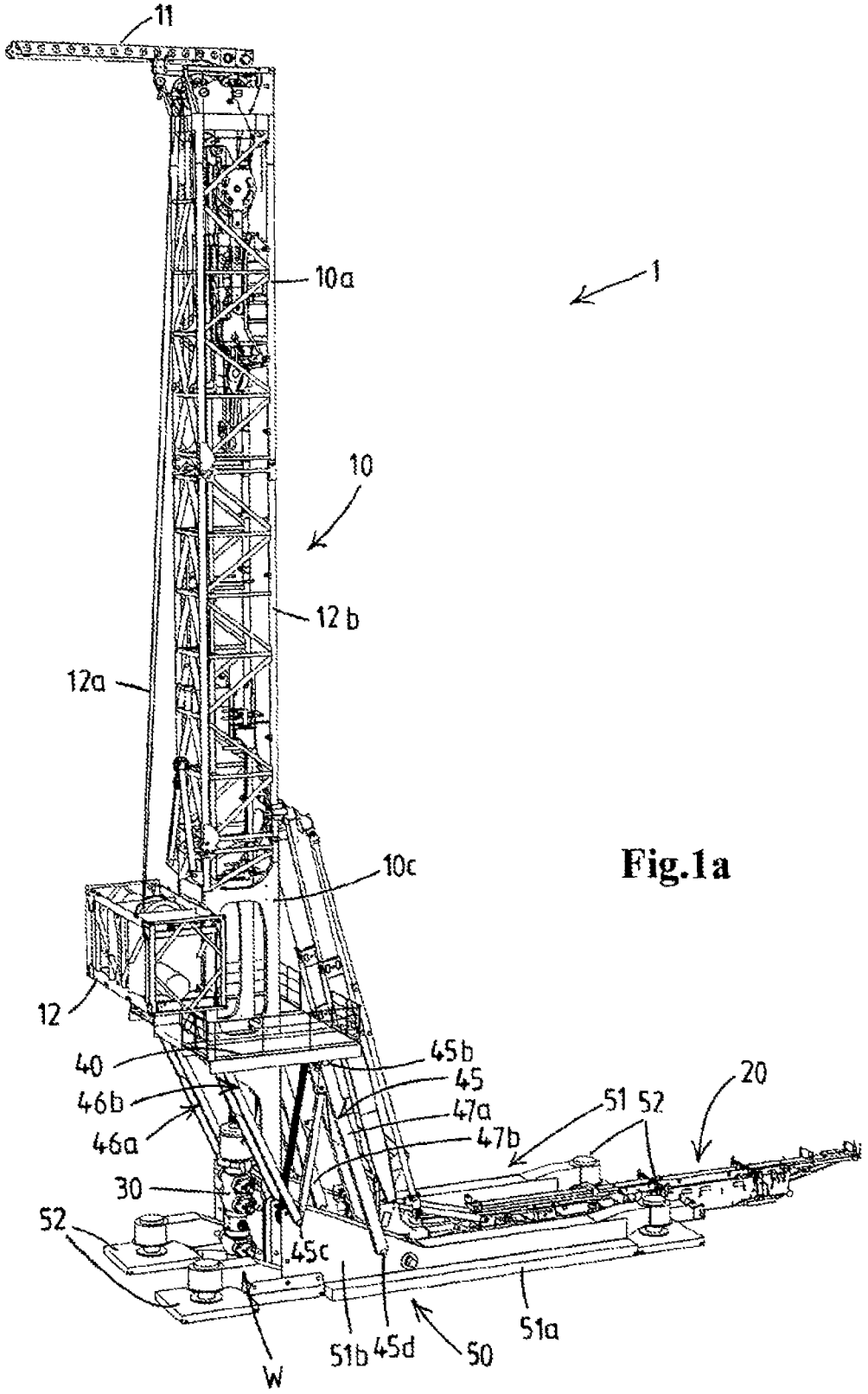
FIGS. 1A and 1B show a modular drilling rig according to the present invention in two different perspective views in an operational position.
Figure 1B:
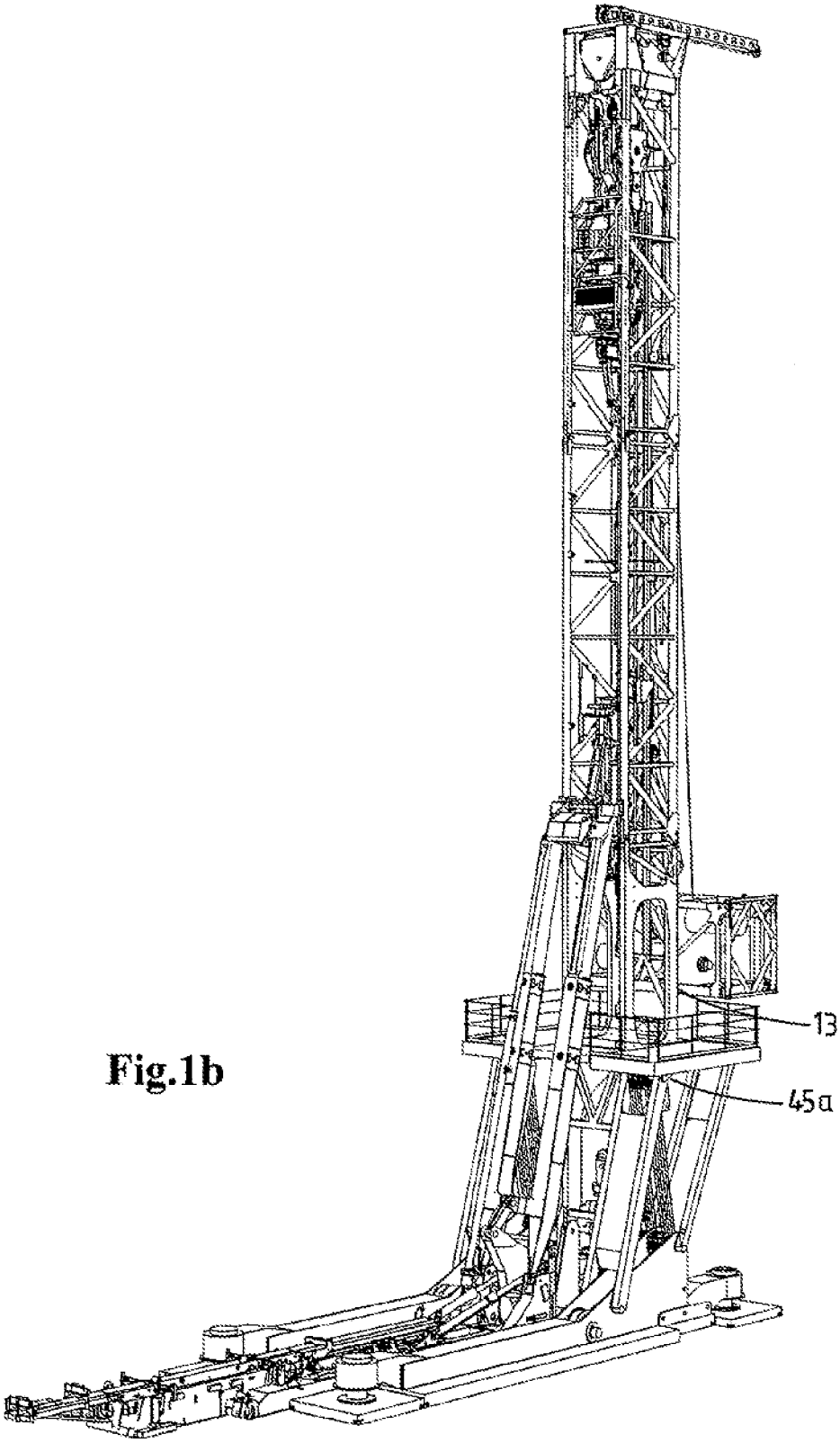

In FIGS. 1A and 1B a modular drilling rig 1 for drilling into a well centre W is shown in different perspective views.

The modular transfigurable drilling rig 1 is shown in FIGS. 1A and 1B in an assembled and operational mode, in other drawings the process of the assembly is shown in more detail. In this embodiment, as it is the operational mode, also a pipe loader 20 is visible, here in a raised position to position a new pipe section into the mast. Also, in these drawings a blow out preventer (BOP) 30 is visible, provided above the well centre W and below the drilling rig mast 10.

From FIGS. 1A and 1B it is visible that the modular transfigurable drilling rig 1 comprises a drilling rig mast 10 which is positioned vertically above the well centre W. The here shown drilling rig mast 10 is composed of three sections: a top section 10*a,* a middle section 10*b* and a bottom section 10*c.* Depending on the size of the drilling rig mast, the mast may be composed of fewer or more sections.

Drilling equipment such as a crown block, travelling block and top drive may be installed within the sections prior to the assembly of the drilling mast 10.

According to an aspect of the present invention, the drilling rig mast, in this embodiment top section 10*a* is provided with a hoist device 11 adapted to hoist drilling drawworks 12—with the mast in its vertical operational position—from the ground to an elevated drawworks position on the mast, as shown in FIGS. 1A and 1B, and wherein the drilling rig mast, in this embodiment section 10*c,* is provided with drawworks connection members 13 to connect the drawworks to the drilling mast at said elevated drawworks position, here spaced above the elevated drill floor 40. In the embodiment, the drawworks comprise cables 12*a* which are reeved into the mast 10 to assist in drilling operations.

In the drawing, a base structure is shown in the operational position. The base structure comprises a well base member (not visible) positioned on the ground near the well centre W, and two transportable base units 51 positioned at either side of the well base member, to form a C-arrangement when seen from above, such that said base units extend side-by-side with a spacing there between. This is shown in more detail in FIGS. 2*a*-2*c.* The base structure comprises a drill floor 40, which is shown in an elevated position above the well centre W and the BOP 30. The drill floor 40 is composed of drill floor members, which are part of the transportable base units 51.

In the shown embodiment, the transportable base units are each provided with skid feet 52. Alternatively, outriggers can be provided.

Figure 2A:
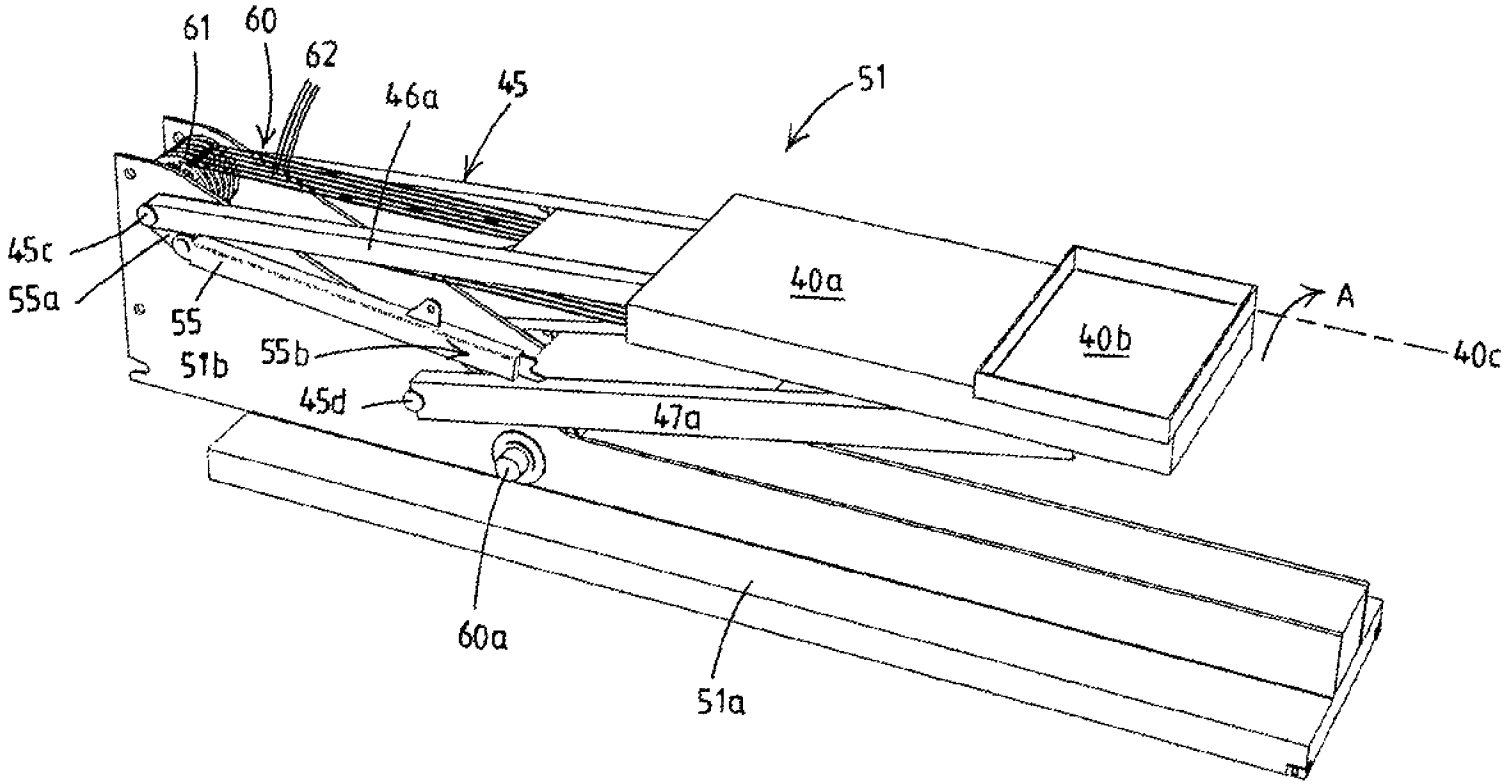
FIGS. 2A-2C show a transportable base unit of a preferred modular drilling rig according to the present invention.
Figure 2B:
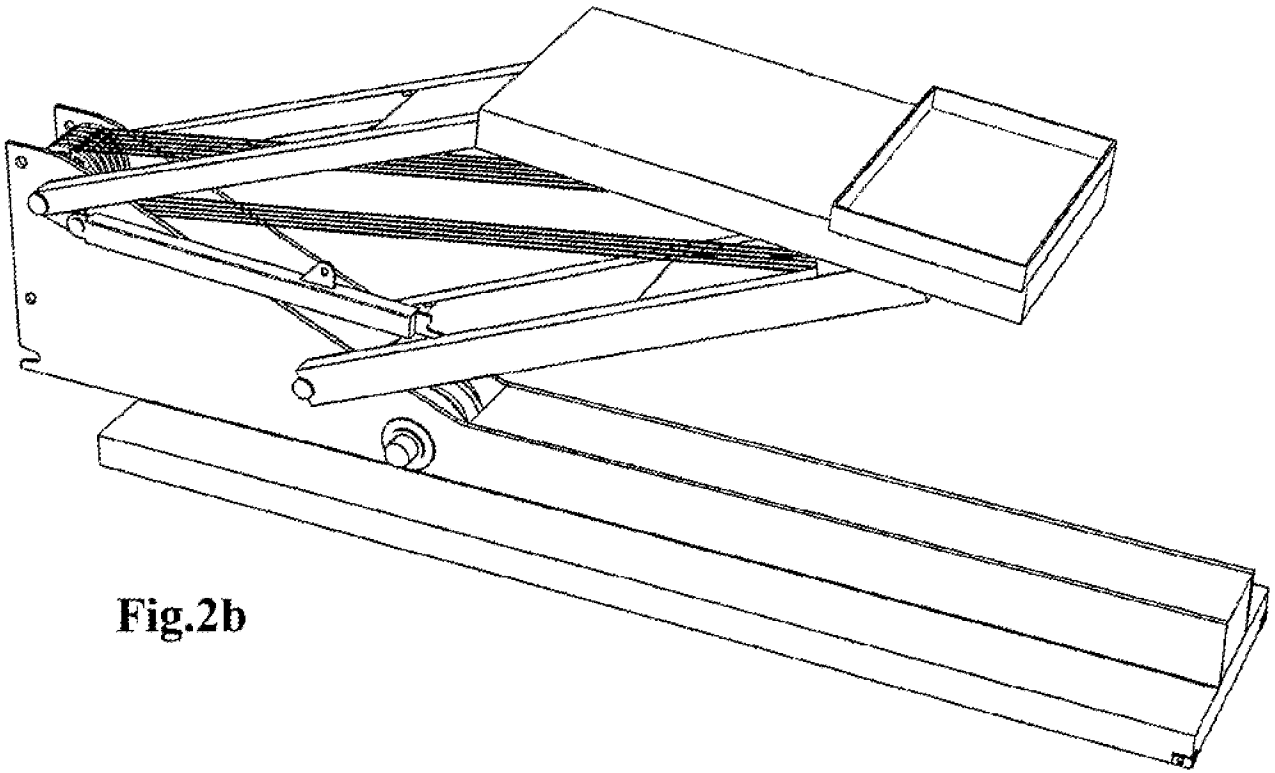
Figure 2C:
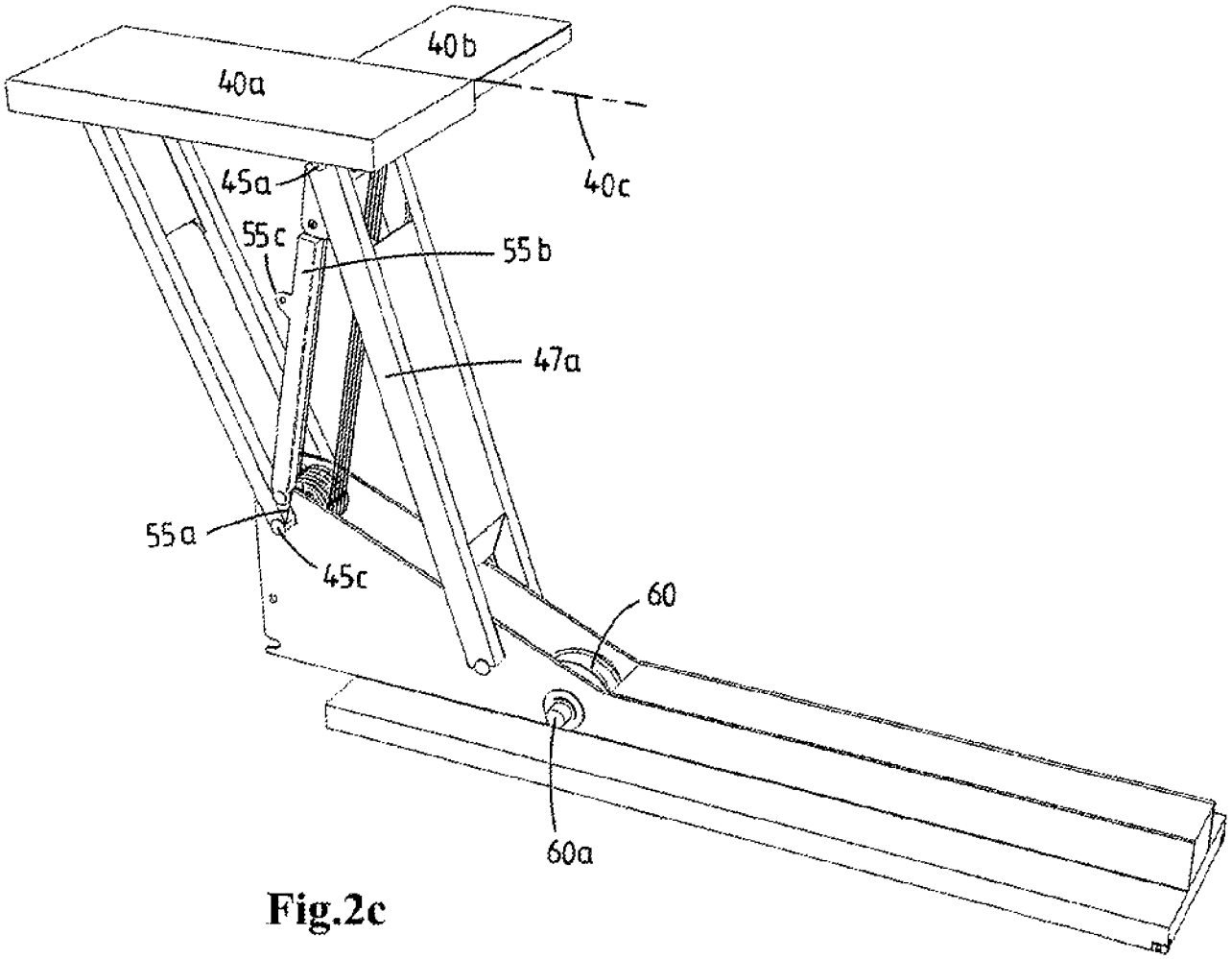

In FIGS. 2*a*-2*c* a transportable base unit 51 according to a preferred embodiment of the invention is shown in more detail. The transportable base unit 51 comprises at least one base member 51*a* including a connection element 51*b.* in the shown embodiment, the transportable base unit 51 comprises two drill floor members 40*a* and 40*b,* wherein drill floor member 40*b* can hinge in direction A about a pivot axis 40*c*. In the raised position of the drill floor, drill floor member 40*b* is allowed to pivot about this pivot axis 40*c* to form a part of the drill floor, as is visible in FIG. 2*c*. The drill floor member 40*a* is connected via a bar-linkage mechanism 45 to the base member connection element 51*b*. In this embodiment, the bar-linkage mechanism forms a four-bar-linkage mechanism 45 comprising two sets of parallel beams 46*a,* 46*b,* 47*a,* 47*b.* Beam 46*a* is pivotally connected to the drill floor member 40*a* via pivot axis 45*a* and via pivot axis 45*c* to the box connection plate 51*b.* Beams 47*a* is pivotally connected to the drill floor 40 via pivot axis 45*b* and via pivot axis 45*d* to the base member connection element 51*b.*

In this embodiment, the transportable base unit 51 also comprises a drive assembly 60. This drive assembly 60 is suitable to simultaneously position the drilling rig mast 10 vertically above the drill floor 40 and the well centre W, and to pivot the bar-linkage mechanism 45 to the raised position. In this embodiment, the drive assembly 60 comprises a hydraulic winch 60, in FIG. 2*a* only the axis 60*a* of which is visible, sheaves 61 and cables 62. The cables extend between the pivot axes 45*c* and 45*a* of the bar-linkage mechanism 45, and as such allow the drill floor and drilling rig mast to be raised.

In this embodiment, the transportable base unit 51 is also provided with a locking mechanism 55 that is adapted to lock the bar-linkage mechanism in the raised position thereof. Here, the locking mechanism 55 comprises a locking bar 55, one end 55*a* of which is connected pivotally about pivot axis 45*c* to base member connection element 51*b* of the base member 51*a,* such that the locking bar extends substantially diagonally between the beams of the bar-linkage mechanism in the raised position thereof, as visible in this FIGS. 1*a* and 1*b*. The other end 55*b* of the locking bar 55 is guided by the bar-linkage mechanism 45 to a raised position. This is visible when looking sequentially at FIGS. 2*a*-2*c*. In FIG. 2*c*, the bar-linkage mechanism is in the raised position, in which the other end 55*b* of the locking bar 55 can be connected to the bar linkage mechanism, in this embodiment to the beam 47*a* of the bar-linkage 45. By connecting these two pivot axes 45*c,*

45*a* of the bar-linkage mechanism, the bar-linkage mechanism 45 is locked against any movement, thereby fixing the position of the drill floor 40.

On the locking bar 55 a hydraulic cylinder may be provided to dampen motion of the drill floor and the drilling mast when reaching their elevated and vertical operation position respectively. In FIG. 2*c*, a cylinder connection point 55*c* is visible; the actual cylinder is not shown in these FIGS. 1-2.

Figure 3:
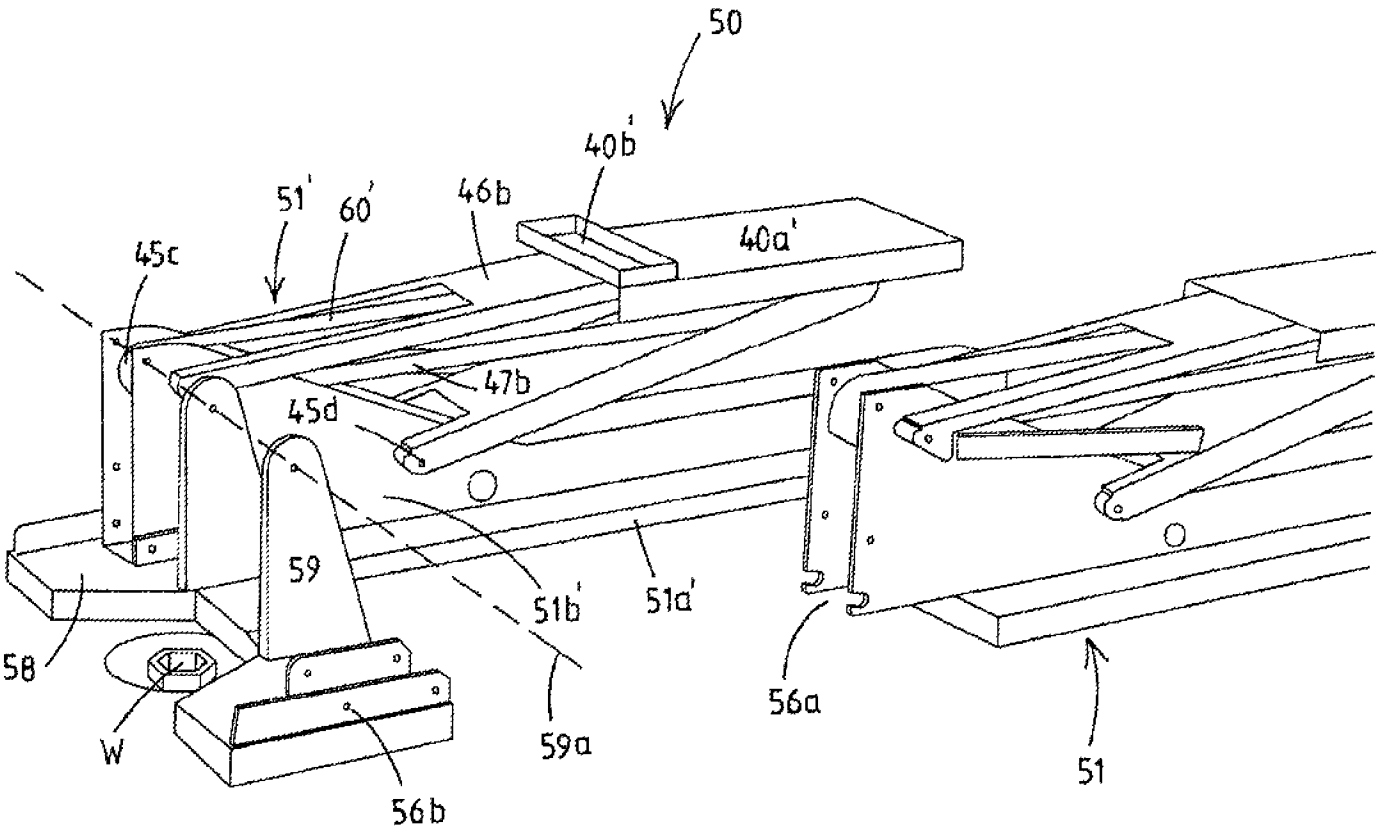
FIG. 3 shows a preferred base structure according to the present invention.

In FIG. 3, the base structure 50 according to the embodiment of FIGS. 1 and 2 of the present invention in shown in more detail. The base structure 50 comprises a well base member 58 positioned on the ground adjacent the well centre W, and two transportable base units 51, 51' positioned at either side of the well base member 58 in a C-arrangement when seen form above, such that said base units extend side-by-side with a spacing there between dimensioned to receive a lower portion of the drilling mast in its substantially horizontal position. Transportable base unit 51' is shown in a position connected to the well base member 58. Transportable base unit 51 is not yet connected to the well base member 58, allowing a clear sight on the connection elements 56*a* of the transportable base unit 51 and the mating connection elements 56*b* of the well base member 58.

Transportable base unit 51 has been described in detail with respect to FIG. 2. In FIG. 3 it is visible that transportable base unit 51' comprises a base member 51*a*' including a connection element 51*b*. Transportable base unit 51' also comprises two drill floor members 40*a* and 40*b*, wherein drill floor member 40*b*' can hinge in a similar way as drill floor member 40*b*. As such, in the raised position of the drill floor, the drill floor 40 is formed of drill floor members 40*a* and 40*a*', and the pivoted drill floor members 40*b* and 40*b*'.

The drill floor member 40*a*' is connected via bar-linkage mechanism 45 to the base member connection element 51*b*'. In this embodiment, the bar-linkage mechanism forms a four-bar-linkage mechanism 45 comprising two sets of parallel beams 46*a*, 46*b*, 47*a*, 47*b*, Beam 46*b* is pivotally connected to the drill floor member 40*a*' via pivot axis 45*a* and via pivot axis 45*c* to the base member connection element 51*b*'. Beam 47*b* is pivotally connected to the drill floor 40*a*' via pivot axis 45*b* and via pivot axis 45*d* to the base member connection element 51*b*.

Transportable base unit 51' also comprises a drive assembly 60.

The well base member 58 comprises a drilling mast foot connection assembly 59, which is positioned between the transportable base unit connection elements 56*b*. In the shown embodiment, the drilling mast foot connection assembly 59 defines a drilling mast foot pivot axis 59*a* about which the drilling mast foot can be pivotally connected to the well base member 58. In the shown embodiment, the drilling mast foot pivot axis 59*a* coincides with pivot axis 45*c* of the bar-linkage. As will be apparent from the following figures, this results in an advantageous embodiment of a drilling rig according to the present invention.

In FIGS. 4-16 show in sequential steps a modular drilling rig according to the present invention which is transfigured from a transport mode to an operational mode.

Figure 4:
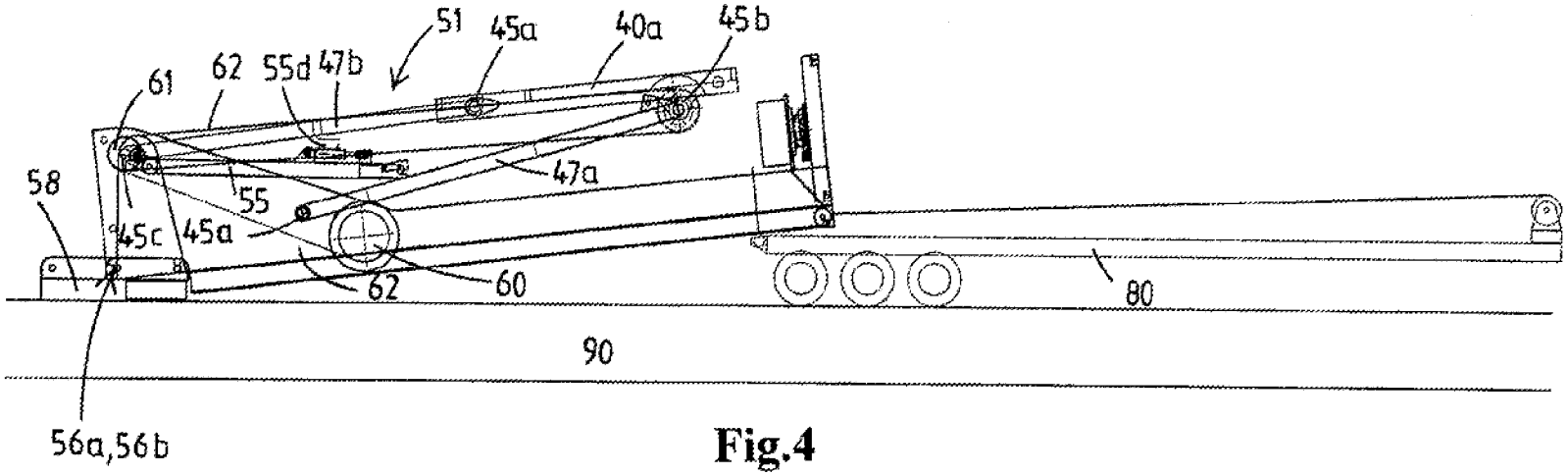

In FIG. 4 a transportable base unit 51 corresponding to that of FIGS. 1-3 is visible in a side view. A well base member 58 has already been positioned adjacent a well centre on the ground 90, which well centre is not visible in this side view. The transportable base unit 51 is connected to the well base member 58 via connection elements 56*a*, 56*b* (explained above in relation to FIG. 3). The transportable base unit 51 is positioned adjacent the well base member 58 with transport means 80, here only schematically indicated. Such transport means generally involve extremely powerful trucks.

Corresponding to the transportable base unit of FIGS. 1-3, the transportable base unit 51 of FIG. 4 comprises drill floor members 40*a*, 40*b* (only 40*a* is visible), beams 46*a* and 47*a* of the bar-linkage mechanism and pivot axes 45*a*, 45*b*, 45*c* and 45*d*. Hydraulic winch 60 is visible, and sheaves 61 and cables 62. In this view, it is not only visible that cables 62 extend between the pivot axes 45*c* and 45*a* of the bar-linkage 45, but also that cables extend between the hydraulic winch 60 and the pivot axis 45*c*.

The locking bar 55 can also be recognized. Now it is visible that a hydraulic cylinder 55*d* is provided to dampen motion of the drill floor and drilling mast when reaching their elevated and vertical operational position respectively.

Figure 5:
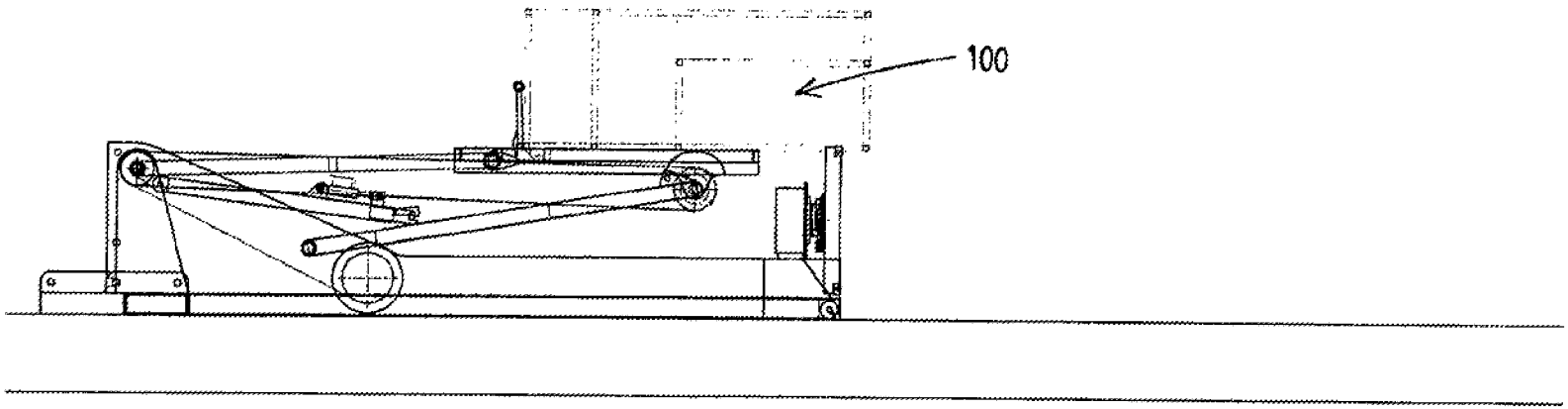

In FIG. 5 it is visible that the transportable base unit 51 is now positioned on the ground 90, and that a drillers cabin 100 is positioned on top of a drill floor member 40*a*. This is an advantageous, but optional step of the method according to the present invention.

Figure 6:
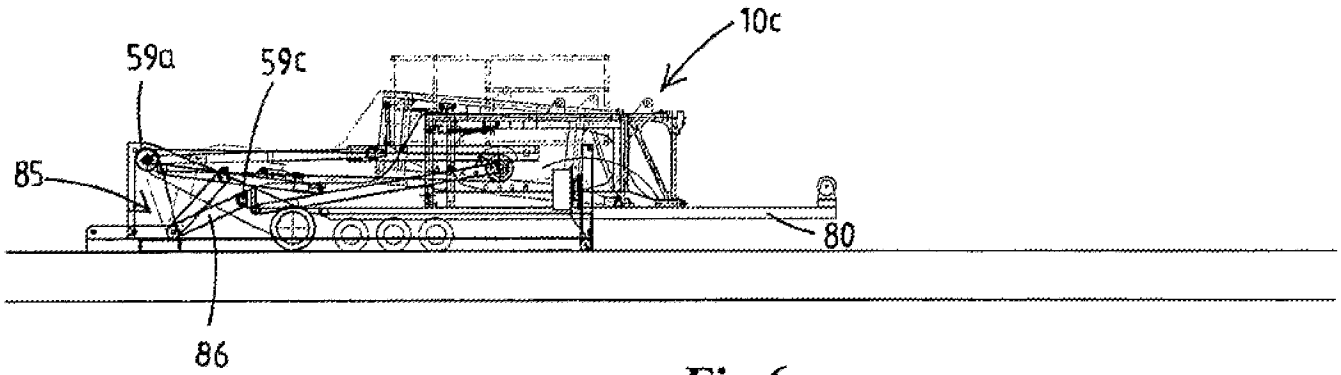
Figure 7:
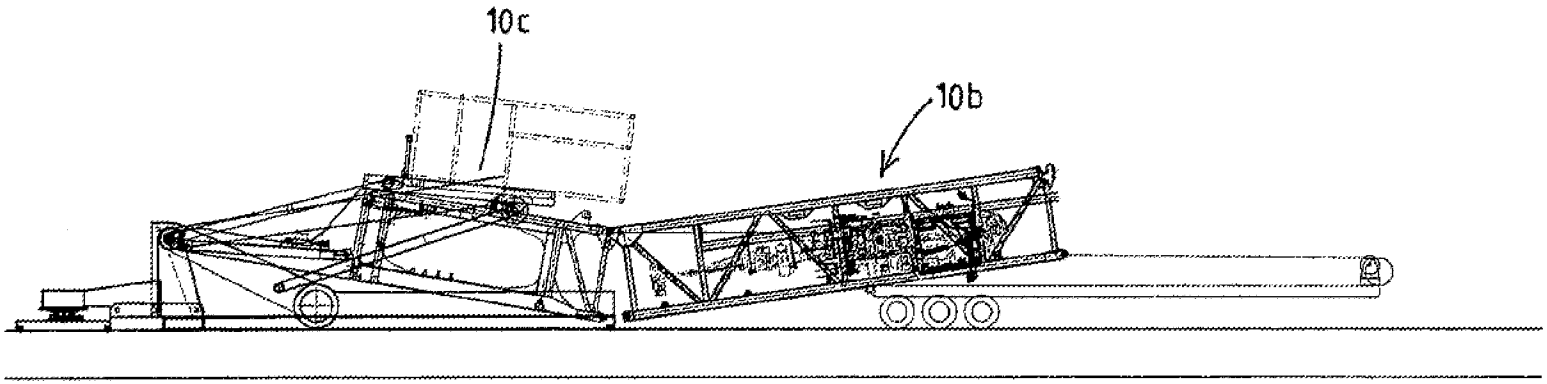
Figure 8:
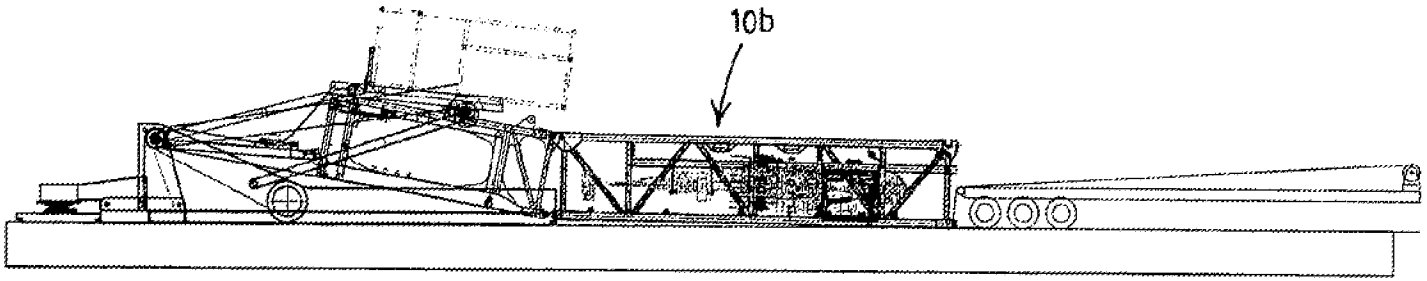
Figure 9:
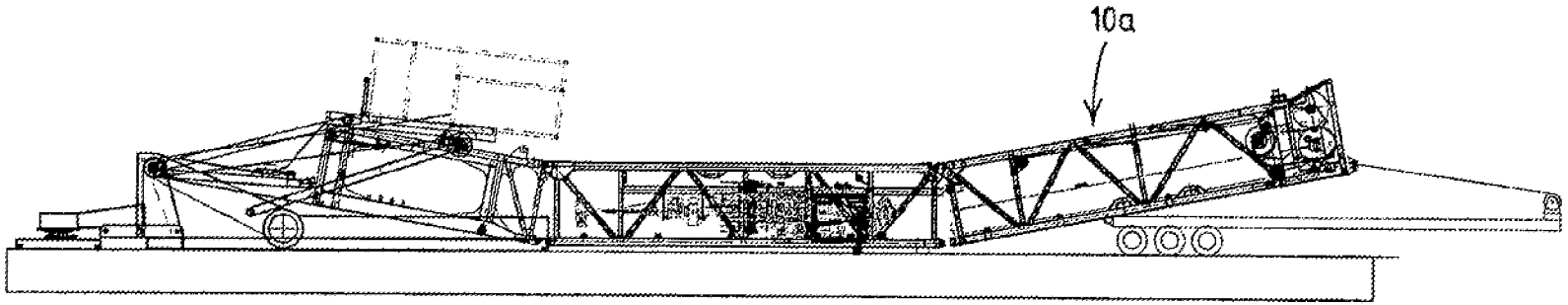
Figure 10:
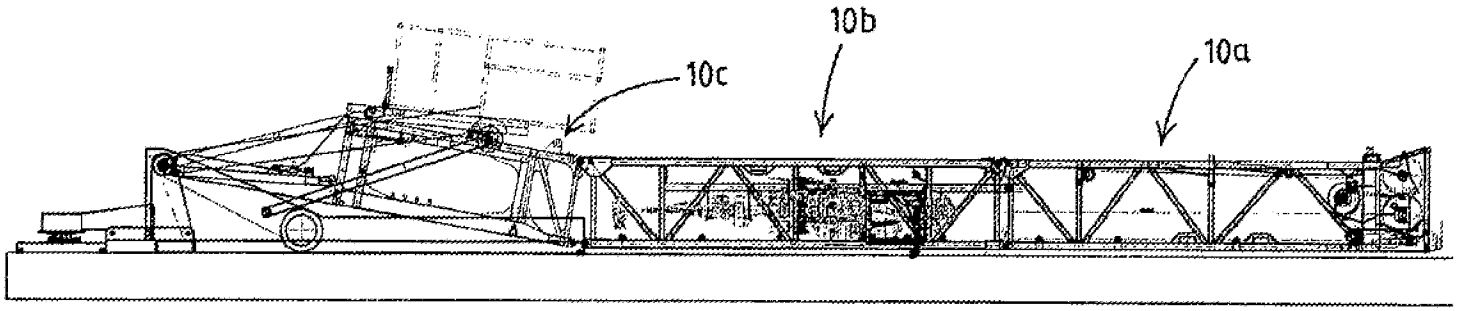

In FIG. 6 a lower section 10*c* of the drilling rig mast 10 comprising the foot of the drilling rig mast is positioned between the transportable base units 51 and 51'. It is noted that this drawing is not entirely correct, as it may seem that the section 10*c* is positioned in front of the transportable base unit 51 instead of behind the transportable base unit 51, seen in this perspective. However, it is clear in FIG. 6 that the foot of the drilling mast comprises a recess 59*c*, which can be connected to the drilling mast foot connection assembly 59 via an axle (not shown), to enable the drilling mast foot to be pivotally connected to the drilling mast foot connection assembly 59 about drilling mast foot pivot axis 59*a*.

Prior to being able to connect the mast foot to the well base member 58, the recess 59*c* needs to be aligned with the drilling mast foot pivot axis 59*a* as defined by the drilling mast foot connection assembly 59. To establish such alignment, in the shown embodiment a guide mechanism 85 is provided, here comprising a pivotable guide rod 86, one end of which is connected pivotable to the base plate 51 and the other end of which can grab and guide the foot of the substantially horizontal drilling mast, in particular the guide the recess 59*c* to the drilling mast foot pivot axis 59*a*. In FIG. 6, the pivotable guide rod 86 is shown in various consecutive positions. Alternatively, the transport means 80 could possibly be modified to enable such an alignment.

Figure 11:
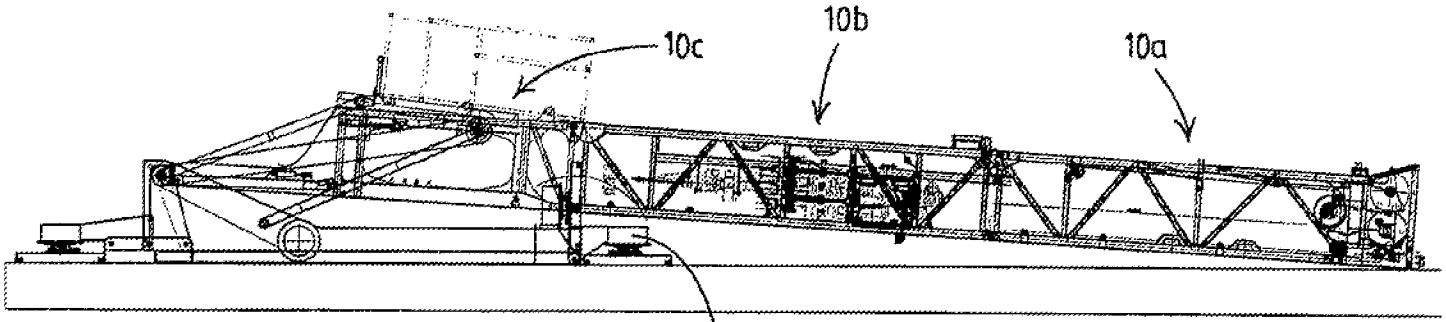

In FIGS. 7-11 the connection of middle mast sections 10*b* to the bottom mast section 10*c* and the connection of top mast section 10*a* to middle mast section 10*b* is schematically shown. In FIG. 11 skid foot 52 of the transportable base unit 51 on the right-hand side of this drawing is visible in a raised and in a lowered position. For stability reasons, it is preferred that the skid feet 52 are in the lowered position prior to raising the mast.

Figure 12:
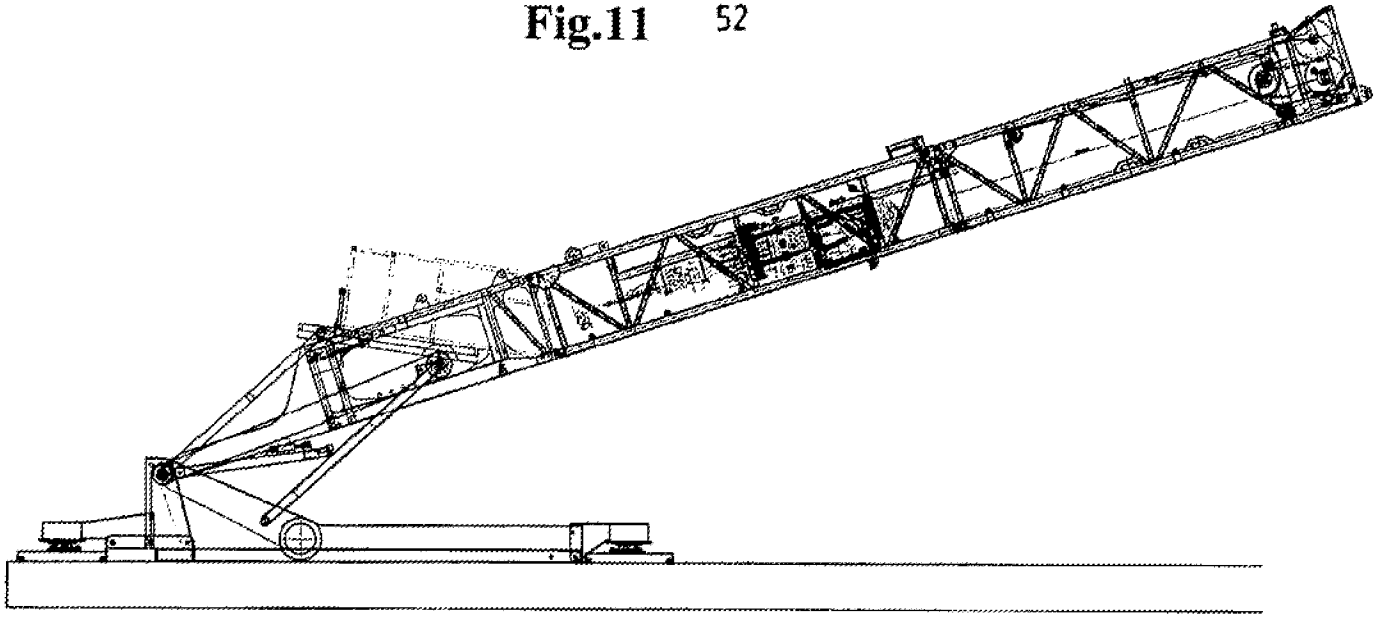
Figure 13:
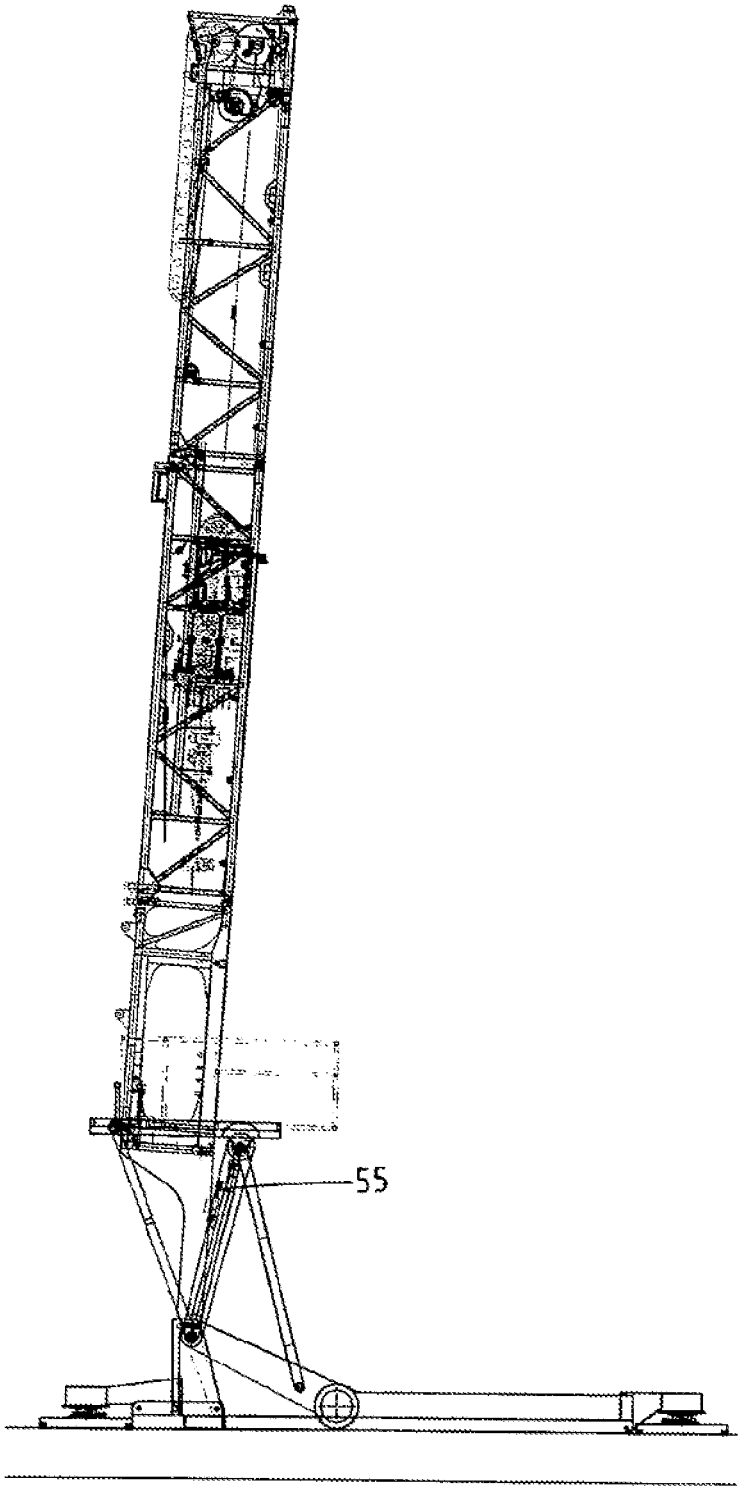
Figure 14:
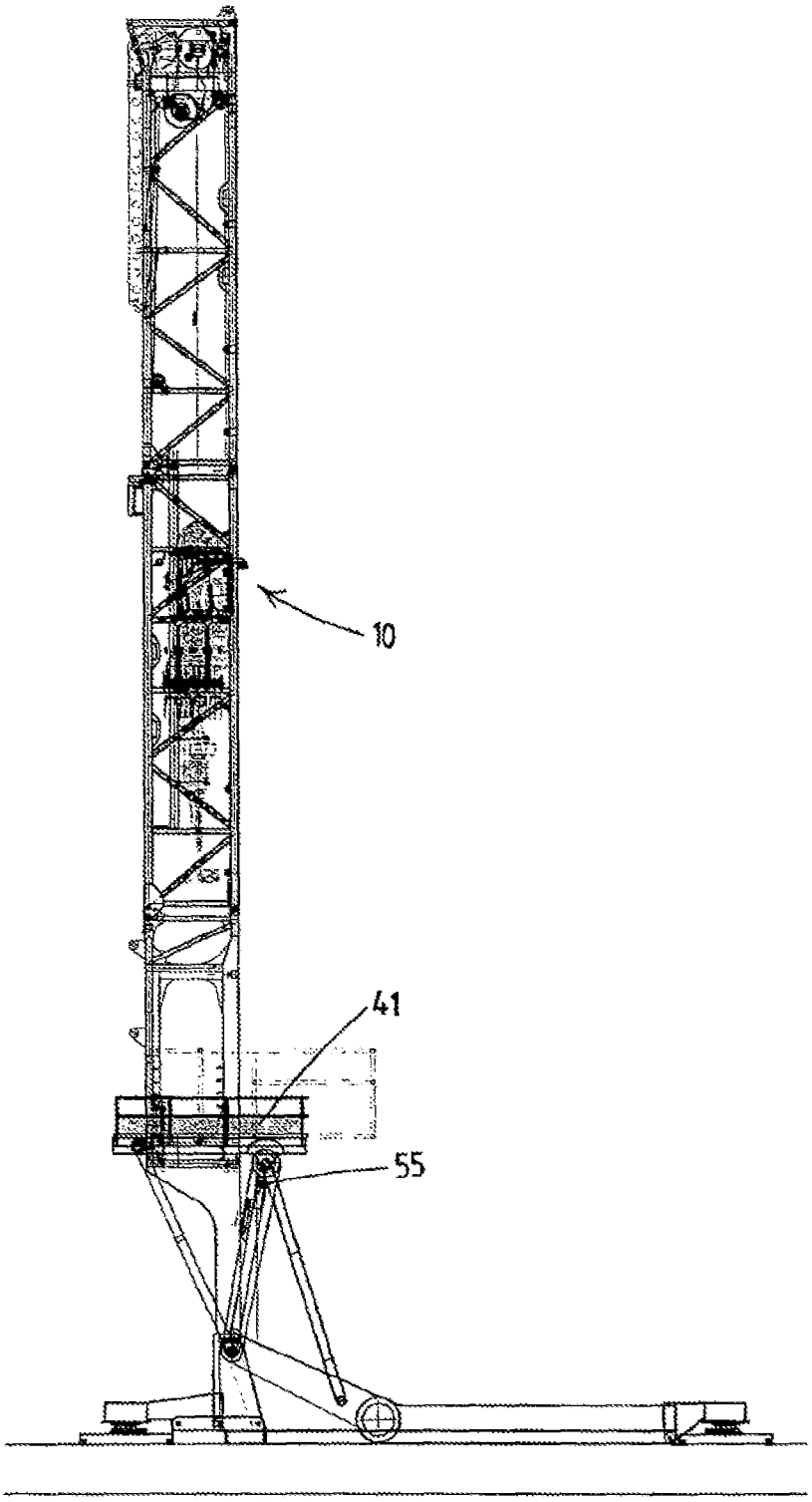

In FIGS. 12-14 the raising of the drilling mast from the substantially horizontal position to the vertical operating position thereof, as well as the simultaneous movement of the drill floor from the lowered to the elevated position is shown. The simultaneous movement is achieved because of the connection of the drilling mast to the base structure, which mast, according to the invention, is connectable to the drill floor member and/or to the bar-linkage mechanism of said transportable base unit. In particular, because of this connection, a moment can be transferred from the bar-linkage to the mast.

In FIG. 13 it is visible that the mast 10 is almost in its vertical position, and the drill floor 40 is almost in its elevated position. The final positioning is influenced in this embodiment by the locking bar 55, in particular by the passive hydraulic cylinder 55*d* provided on the locking bar 55, slowing down the raising movement of the construction.

In FIG. 14 the mast 10 is locked in its vertical position. Also, the folding out of drill floor bridges 41 is visible.

Figure 15:
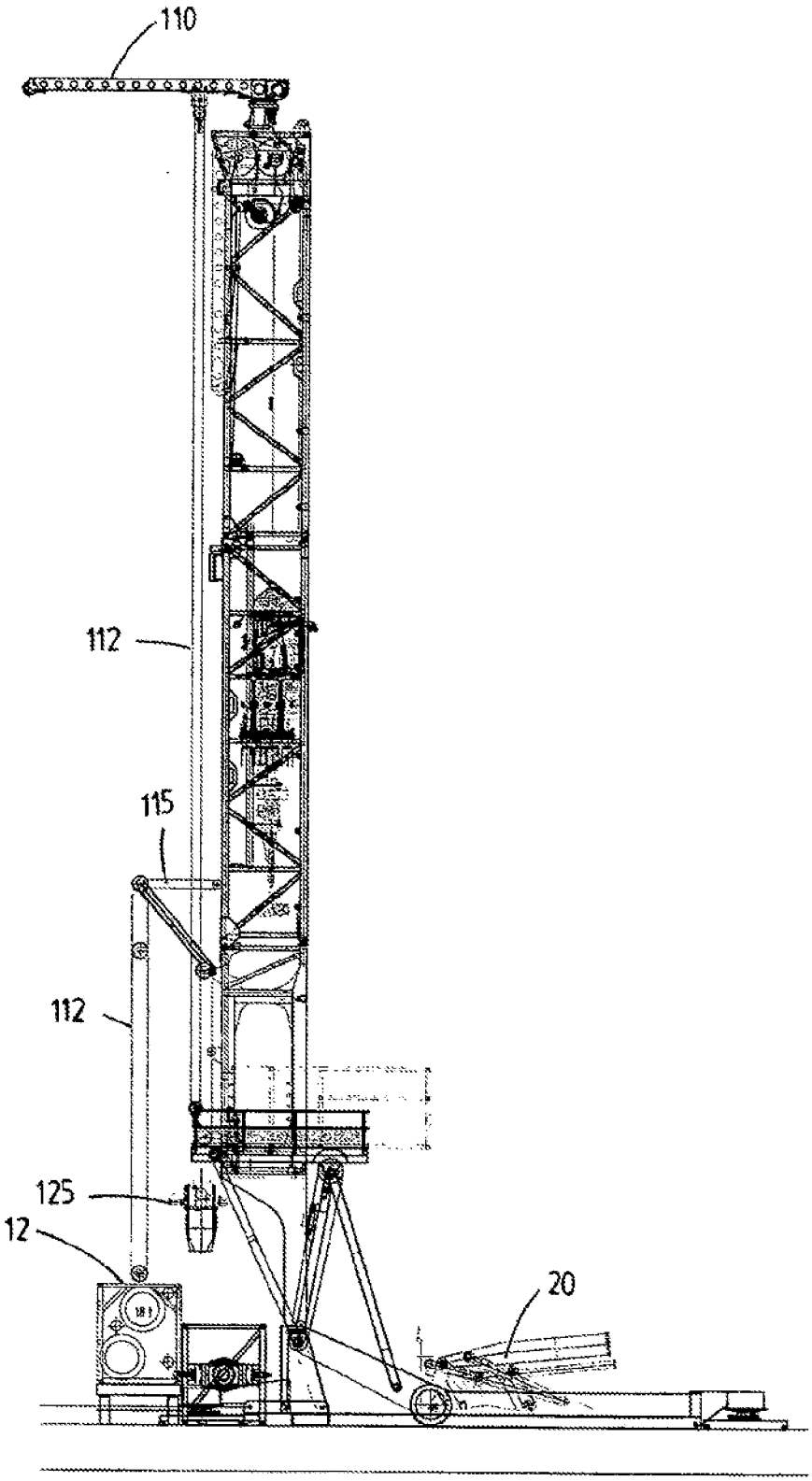

In FIG. 15, the folding out of a mast service crane 110 from the top mast section 10*a*, and the folding out of an auxiliary jib 115 from the middle mast section 110*b* is visible. Between this mast service crane 110 and auxiliary jib 115 a drawworks hoist cable 112 is reeved, to hoist a drawworks container 12 from the floor to an elevated drawworks position, as is visible in FIG. 16 and in FIGS. 1*a* and 1*b*. In the elevated drawworks position, the drawworks container 12 may be connected to the mast 10. It is noted that in FIGS. 15 and 16, the mast service crane 110 is shown both in its retracted position adjacent the mast section and its folded out position.

In FIG. 15, also the installation of a Bell nipple 125 and a first section of a pipe loader 20 is visible.

In FIG. 16, the pipe loader 20 is installed and a pipe rack and pipe tubs, schematically indicated with reference number 130 are brought in position on the drilling site. Also, an accumulator unit and hydraulic power unit, schematically indicated with reference number 135 are installed. The BOP 30 is brought into position.

With reference to FIGS. 17-42 now a further embodiment of a modular drilling rig according to the present invention will be described. This description will explained several features than may be of use independent from one another when desired in the rig according to the invention and can also be applied in combination with the previously explained embodiment of the rig when desired.

With reference to FIGS. 18-26 the base structure 150 of the drilling rig and preferred features incorporated in said structure 150 will be explained in more detail.

The base structure 150 is mainly composed of two transportable base units 151 and a well base member 158 that is to be position close to a well. As will be explained below the structure 150 may also include feet 152 and possibly other elements.

It is envisaged that—for installing the base structure—the well base member 158 is placed on the ground first and then the two units 151 are each placed on the ground and connected to the base member 158 to arrive at a general C-shaped arrangement when seen from above with the units 151 side-by-side with a spacing there between.

This C-shape arrangement is for example favorable during the periods of assembly and disassembly of the mast of the rig as a vehicle carrying the mast, or a section thereof, can be driven between the base units so as to bring the foot of the mast close to the well base member. It is envisaged that—in an embodiment—after the assembly and raising of the mast, one or more additional transverse connections are made between the base units, so that they are not only connected via the well base member but also at one or more locations remote from the well base member. In an embodiment thereof, a pipe loader is positioned in the shape between the base units, and in a possible version thereof the pipe loader acts as an additional connector between the base units in addition to the well base member.

Preferably, as shown here, the well base member 158 is provided at a side thereof with two sets of connector members 156*b*, each set being adapted to connect to one or more corresponding connector members 151*b* arranged at an axial end face of a unit 151. In this example the well base member 158 and the units are effectively hooked to one another, as the well base member is provided with hooks that engage between a pair of rods on the axial end of each unit. One or more other connector members, e.g. locking bolts, can be arranged to further secure the units to the well base member 158. Other secure connector members, e.g. simple bolts extending through aligned holes, can also be provided as connector members.

As is preferred, a pipe loader device 120 is placed in the space between the units 151 (see FIG. 17), the pipe loader being adapted to move drilling tubulars, e.g. drill pipe, between a storage and the mast, as is preferred the loader 120 being embodied to grip a tubular with a gripping member, and the gripping member being movably supported in the loader device to allow for a change or orientation of the gripped tubular between a vertical position at or near the mast and a horizontal position at or near the storage, e.g. to allow pick-up of a tubular in horizontal position from the storage by the gripping member.

Each base unit 151 includes a base member 151*a*, a drill floor member 140, and an associated bar-linkage mechanism 145 with further elements that together with the drill floor member 140 represent the mobile bars of the mechanism relative to the base member. The base member 151*a* effectively forms the stationary frame of the base unit.

The bar-linkage mechanism 145 of a base unit 151 here has a single pivotable beam 147 only instead of two pivotal beams as in the FIG. 1 embodiment, The beam 147 extends between the base member 151*a* and the drill floor member 140. The beam 147 is pivotally connected at a base end thereof to the base member 151*b* about a pivot axis 147*a* and pivotally connected at a drill floor end thereof to the drill floor member 140 about pivot axis 147*b*. Both axes 147*a, b* are horizontal.

At a position remote from the pivot axis 147*b*, towards the well base member 158, the drill floor member 140 is provided with a releasable pivotal connector 141, that is adapted to establish a pivotal connection between the drill floor member 140 and the mast 110 about a pivot axis 141*a* which is horizontal as well. The connection is made during the installation process of the rig and disconnected when the rig is to be disassembled for transportation to another drilling site. For example the connector 141 may be as simple as a rod to be passed through aligned holes in the floor member 140 and the mast. In another embodiment the drill floor is provided with a movable pivot connector member 141, e.g. driven by a hydraulic cylinder, that is made to enter a corresponding recess or hole 141*b* (see FIG. 23) in the mast.

In this example the well base member 158 comprises a drilling mast foot connection assembly 159, which, as is preferred, is positioned between the transportable base unit connector members 156*b*. The pivotal connection assembly 159 allows that the mast can be assembled in general horizontal direction with its lower end in the space between the base units 151 and connected at its lower end to the base structure, here to the well base, so as to be pivotal for erecting the mast 110. Here the assembly 159 includes spaced apart flanges with aligned holes through which a pivot bolts or shaft are/is passed when the foot of the mast is aligned with the holes.

The drilling mast foot connection assembly 159 of the well base member 158 defines a horizontal drilling mast foot pivot axis 159*a* about which the drilling mast foot can be pivotally connected to the well base member 158. This connection about axis 159*a* is remote from the position where the pivotal connector 141 engages on the mast 110. It is also remote from the location of pivot axis 147*a*.

It will be appreciated that in another embodiment the drilling mast foot may be pivotally connected to a connection assembly that is formed by parts of the base units 151 and not of the well base member 158 or by parts of a further separate member that is part of the base structure, e.g. connected between the units 151 at a location adjacent the well base member 158.

The skilled person will appreciate that main components of the base unit 151 described above, including the pivotal connection of the drill floor member 140 to the mast 110 and of the mast foot to the base structure, results in a four-bar linkage mechanism with four parallel and horizontal pivot axes, wherein the beam 147 is one of the movable bars and the section of the mast between the axis 141*a* and 159*a* effectively is another movable bar of the mechanism. The drill floor member 141, between its pivot axis 141*a* and 147*b* effectively is yet another movable bar of the mechanism.

To enhance the compactness of the base unit 151 for its transportation, it is envisaged that the drill floor member 140 is pivotal on command about the axis 147*b* between a collapsed transportation position (FIG. 20) and a raised connection position (FIG. 24) wherein the connector 141 is correctly positioned to be coupled with the mast 110 at axis 141*a*, which mast is at said moment connected to assembly 159. To perform this pivotal motion, and reverse, a drill floor member pivot drive motor is envisaged between beam 147 and the drill floor member 140, e.g. a hydraulic cylinder (not shown).

To move the drill floor member 140 to its elevated position and to simultaneously move the mast 110 to its vertical operation position the base unit 151 includes an integrated drive assembly with a winch 160, a cable 162 and an arrangement of sheaves 161*a, b*.

As is preferred the winch 160 is a drum type winch, having a drum onto which cable 162 is wound.

As is preferred the winch 160 has one or more hydraulic winch drive motors. A hydraulic power unit including a pump and hydraulic reservoir may be integrated into the unit 151 or a remote located hydraulic power unit can be employed to provide hydraulic power to the winch 160.

In a preferred embodiment the winch has one or more hydraulic drive motors and the base unit is provided with a hydraulic power unit including a pump and a reservoir for hydraulic fluid, more preferably the pump having an electric pump motor and the base unit being provided with a fuel powered generator providing electricity for the pump motor and possibly electrical control of the hydraulic system.

It is envisaged that in order to obtain a redundant structure for electrical power in the base units of a rig, the generator of one base unit can also be connected to provide electrical power to the other base unit, so that even in case of failure of one generator the base units remain functional.

The base unit may, in addition to a hydraulic winch, include more hydraulic actuators, e.g. a drill floor member actuator as explained herein, and possibly one or more other hydraulic actuators for other additional functions, e.g. moving a floor plate of the drill floor, etc. A control for the hydraulic system can e.g. be embodied for remote control, e.g. an operator carrying a control box as is known in the field of cranes.

In order to multiply the force exerted by the winch, the cable 162 is passed in a multi-fall arrangement between a first set of sheaves 161*a* connected to the base member 151*b* and a second set of sheaves 161*b* connected to a mobile part of the bar-linkage member, here to sheaves connected to the upper end of the beam 147, here such as to have their rotation axis coincide with the axis 147*b*—as is preferred. In another embodiment as second set of sheaves 161*b* could be arranged on the beam 147 remote from axis 147*b* or on the floor member 140, possibly remote from axis 147*b*.

To enhance the compactness of the base unit for its transportation, in particular in view of the height of the base unit, yet to allow for an effective application of the winch force in particular when raising the mast from its horizontal position, the base unit 151 illustrates the provision of a mobile arrangement of the first set 161*a* of sheaves relative to the base between a transportation position (FIG. 21) and an operative position (FIG. 22), preferably said operative position being higher relative to the base member 151*b* than the transportation position. The mobile arrangement is primarily embodied such that the displacement to its operative position of the first set of sheaves 161*a* increases the angle between the beam 147 and the cable 162—with the beam 147 still in its transportation position. The increased angle of the cable 162 causes an increase of effective momentum caused by the pulling of the winch 160 to raise the drill floor member 140 and mast connected to the linkage mechanism. This in turn allows for a weight reduction of the base unit, which facilitates its handling and transportation, e.g. as the internal forces within the base unit are also reduced by the increased angle of the cable.

As to the height reduction it is envisaged, in a preferred embodiment, that the base unit 151 is embodied to be dimensioned as an ISO freight container, e.g. having a (maximum) height of 8 feet. This constraint, in view of the preceding paragraph, can best be met by providing the first set of sheaves 161 and its carrier in a mobile manner in the base unit 151.

The first set of sheaves 161*a* is mounted on a mobile carrier 154 that is mobile mounted on the base member 151*b* of the unit 151.

In this example it is illustrated, as is preferred, that the mobile arrangement of the first set 161*a* of sheaves is combined with mobile arrangement of the winch 160 as they are mounted on a common mobile carrier 154.

In this example it is illustrated, as is preferred, that the mobile carrier 154 is pivotally mounted on the base member 151*b* so as to be pivotal between a transportation position (FIG. 21) and the raised operative position (FIG. 22).

A mobile carrier drive motor, e.g. a hydraulic cylinder, is preferably integrated in the base unit 151 to perform the motion of the carrier 154 relative to the base. As explained a hydraulic drive motor for this purpose may form part of an integrated hydraulic system of the base unit.

As is preferred a locking arrangement, e.g. with one or more locking pins 154*a* is provided to lock the carrier 154 in its operative position.

Instead of a pivotal arrangement of the carrier 154 the mobile mounting could also include a sliding arrangement, e.g. along an upward guide to cause the raising of the first set of sheaves 161*a* to their operative position.

The base structure 150 here, as is preferred, also includes support feet 152 that support the entire rig on the ground. As is preferred two feet 152 are integrated in or connected to the well base member 158 and each base unit 151 is provided with a further foot 152 at its axial end remote from the base member. These further feet 152 may be integrated with the base member 151*b* or connected thereto as separate items.

As can be seen the two feet 152 that are integrated or connected to the well base member 158 are envisaged to be positioned such that the well is positioned in the area between the well base member 158 and the locations where the feet rest on the ground.

The two feet 152 that are integrated or connected to the well base member 158 could, as here, each have an arm 152*a* that is pivotally connected to the well base member 158 about a vertical axis 158*b*, so that said arms 152*a* can be brought into a spreaded position to increase the distance between the feet and increase the stability of the rig.

In a preferred embodiment the feet 152 supporting the rig are embodied to allow for displacement of the rig with the mast 110 in erected position over the ground, similar to stepwise walking.

In FIG. 18 the well base 158 is placed on the ground, preferably close to a (proposed) well. As is preferred the well base has dimensions similar to an ISO freight container, e.g. provided with ISO corner fittings allowing to secure the well base on a trailer, train, etc during transportation as a freight container.

In FIG. 19 two feet 152 are connected to the well base. As explained it is also envisaged for said two feet to be integrated with the well base and handled as a single unit for transportation. However, as it is preferred for each foot 152 to have a ground engaging plate with significant support surface, e.g. of dimensions similar to an ISO freight container (e.g. a width and/or length of 8 feet) transportation is facilitated if the feet 152 are each transported as separate units. Preferably each foot plate is provided with ISO corner fittings allowing to secure the foot on a trailer, train, etc during transportation as a freight container.

In FIG. 20 the two base units 151 of the rig have been connected to the well base member 158 to form a C-shaped arrangement when seen from above. Also two further feet 152 have been installed, each connected to a corresponding base unit. As is preferred each further foot 152 is connected to the base unit at the axial end remote from the connection to the well base member 158.

The base units 151 in FIG. 20 are still in their compact transportation configuration, wherein a unit 152 requires minimum space and has a reduced height allowing transportation thereof by a road vehicle, e.g. on a trailer. For example the height of the base unit in this configuration is 8 feet.

In the compact transportation configuration the drill floor member 140 is generally horizontal, close to the base member.

In FIG. 21 the floor members have been brought into a raised position by means of an associated drive motor, e.g. hydraulic cylinder between the drill floor member 140 and the beam 127. At this stage, the raising of the drill floor members 141 is primarily done in view of the next step, wherein the carriers 154 are raised into their operative position by another drive motor. As can be seen by comparing FIGS. 21 and 22 this raising of the first set of sheaves 161*a* relative to their position during transportation of the unit 151 brings the multiple fall cable 162 in a much more efficient position to exert the required lifting force on the drill floor and later also the mast connected thereto. The increased angle of the cable 162 relative to the beam 147 can clearly be discerned. It can also be seen that upward tilting of the drill floor member 140 is required for the cable 162 to assume this favorable initial position.

Once the base structure 150 has been prepared as explained, the installation continues with the provision of the mast 120. As preferred the mast 120 is to be assembled from sections that are supplied to the drilling site as separate units, e.g. on trailers as shown here.

FIG. 23 shows the base structure of FIG. 22 with a lower mast section 120*a* supplied on a transport vehicle 170, here lying on a trailer, and moved between the base units so that the foot end of the lower mast section 120*a* is brought close to the well base member 158 so as to allow connection thereof to the well base member via assembly 159.

In FIGS. 23 and 24 it is shown that that the lower mast section 120*a* comprises a lowermost section member that is hinged to an upper section member so that the lowermost section can assume an angled configuration (see FIG. 23) and a straightened configuration (see FIG. 24). It is envisaged that one or more hydraulic actuators are present in the lower mast section 120*a* to allow for tilting the lowermost section member to obtain the angled configuration and to cause the straightening of the lower mast section when desired. For example actuators are arranged between the lowermost section member and the upper section member, or on the lowermost section member to engage on the transportation vehicle.

The ability to tilt the lowermost section member, relative to the upper section member lying on the trailer, so as to obtain the angle configuration is that this allows the axis 159*a* to be arranged higher than the mating portion of the lowermost section member when this member is still lying horizontally on the trailer 170. To overcome this height difference the lowermost section member of the mast section 120*a* has been raised in FIG. 23, e.g. by a hydraulic lifting device mounted in the lower end of the mast or on the trailer.

FIG. 24 shows the presence of a recess or hole or other connector member 141*b* in the lower mast section 120*a* at a position remote the pivot axis 159*a* so that the intermediate part of the mast will effectively for a mobile bar of the four-bar-linkage mechanism. This requires alignment of the member 141*b* with the connector 141 on the drill floor member 140 which is done here by manipulating the angle of the drill floor member 140 by operating the winch 160 of the base unit 151 to the position in FIG. 25 where the connector 141 is aligned with the member 141*b* on axis 141*a*.

In FIG. 26 it is shown that the drive assembly has been operated to raise the mast section 110*a* from the trailer of the road vehicle 170. The four-bar-linkage mechanism is now utilized as the winch 160 pulls in the cable 162 thereby bringing the sheaves 161*b* closer to the sheaves 161*a* which causes an upward pivoting motion of the beam 147 and the mast portion 120*a* that forms a further bar of the four-bar-linkage mechanism connected pivotally to the base member 151*b* and the drill floor member 140.

FIG. 27 depicts the progress of the assembly of the mast 110 as a middle section 110*b* is connected to the lower mast section 110*a*. The middle section is supplied on a trailer of vehicle 171 in lying condition. In order to align the upper end of the section 110*a* with the lower end of section 110*b* the mast section 110*a* has been tilted downward to obtain alignment. Then the connection is established only at the adjoining top facing corners or sides (at 115) of these mast sections 110*a*, 110*b*, this connection forming a temporary hinge. In FIG. 26 it is shown that the lower mast section has hooks 110*a*1 at said top facing corners, the mast section 110*b* having mating members to establish a hinged connection.

Then the lower mast section 110*a* is raised again by operating the drive assembly to obtain full alignment of the mast sections 110*a* and 110*b* so that their lower corners also meet and the mast sections 110*a,b* are then raised somewhat further so that the mast clears the trailer which is then driven away as shown in FIG. 29. It is noted that the lower corners of the adjoining mast sections 110*a* and 110*b* are not connected yet, as will be explained below.

The mast section 110*b*, and possibly also other mast sections of the mast or portions thereof, has, as is preferred, a c-shaped cross-section with three latticed sides having vertical longitudinal columns at their corners and a lattice framework there between. The mast section 110*b* has one open side, said open side facing downwards when the mast is held in generally horizontal position relative to the base structure. The open side provides an opening to allow for a top drive 180 to be brought into the space within the contour of the mast section 110*b*.

Before the top mast section 110*c* is connected to the mast, it is envisaged that top drive 180 is supplied by a vehicle 172 in horizontal or lying condition as is preferred to facilitate the transportation thereof. As shown and preferred, the top drive 180 lies on a vehicle trailer which is parked underneath the middle mast section 110 that is now held in generally horizontal position.

FIG. 31 depicts that the mast is lowered by operation of the drive assembly, so that the middle section 110*b* comes to rest on the trailer. It is shown that the sections 110*a* and 110*b* assume an angled orientation relative to one another, interconnected by the temporary hinge as explained above. Now the section 110*b* is horizontal on the trailer 172.

As the open side of the mast section 110*b* is directed downwards at this stage, the top drive 180—still lying on the trailer 172—comes into the space defined by the contour of the mast section 110*b*. The top drive 180 is then connected to the mast section 110*b*, e.g. to one or more guide rails extending longitudinally along the mast section 110*b*. For example the mast section 110*b* includes one of more longitudinal guide rails equipped with one or more trolleys thereon, the top drive being connected to the trolley or trolleys, e.g. by bolts. It will be appreciated that another connection arrangement, possibly a merely temporary fastening by slings or ropes, is also possible between the top drive and the mast section.

FIG. 32 depicts the raising of the lower mast section 110*a* so that the middle section 110*b* becomes fully aligned again with the lower mast section 110*a*, and now the lower corners of these sections 110*a*, 110*b* are securely interconnected, e.g. by locking pins or bolts. It is shown that raising mast section 110*a* entails raising the mast section 110*b* and thereby lifting the top drive 180 from the trailer 172 which can then depart.

In FIG. 33 it is depicted that the top mast section 110*c* is supplied by vehicle 173. This top section 110*c* is preferably connected to the middle mast section 110*b* in the same way as the connection between the middle mast section 110*b* and the lower mast section 110*a*.

The top section 110*c*, as is preferred, includes a crown block 184 and a travelling block 185 that is to be connected to the top drive 180 to raise and lower said top drive and the attached drill string. As is common and preferred, the blocks 184 and 185 each have a set of multiple sheaves to allow for a multiple fall cable arrangement.

The top section 110*c*, as is preferred, includes a hoist device or crane 111 that is adapted to hoist a drilling drawworks unit 112, including primarily one or more winches that are adapted to hoist the drill string and top drive, to an elevated position on the mast once the mast has been erected (see FIGS. 38-41).

As is preferred the hoist device 111 has been pre-assembled onto the top section 110*c* and comprises an arm 111*a* that is pivotable between a transportation position alongside a side of the top section 110*c* (see FIG. 33) and an operative position at right angles to the mast (see FIG. 34-41), preferably the arm 111*a* being supported in a bearing so to allow revolving 360° about a vertical axis when the mast 110 is erected.

The top section 110*c* is connected to the middle section 110*b* in the same manner as the middle section 110*b* to the lower section 110*a*, so that the completed mast can be raised to clear from the trailer 173 which then departs.

With the top drive 180, as is preferred, still within the middle section 110*b*, the drive assemblies of both base units 151 are now operated to obtain a complete raising of the mast 110 into its vertical operating position as shown in FIG. 35. When said position has been reached some locking mechanism is preferably employed, e.g. with a locking bar as discussed with reference to the FIG. 1 embodiment or similar, to ensure this operative position.

Figure 37B:
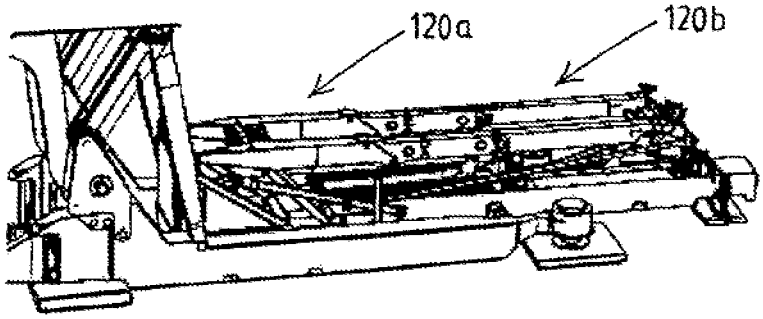

The FIGS. 36*a*, *b* show the supply by a vehicle 174 of a first part of a pipe loader device 120, which first part 120*a* is stationed between the base units 151. A second part 120*b* of the pipe loader device 120 is then also supplied and connected to the first part to obtain a complete pipe loader 120 as shown in FIG. 37.

As can be seen the vehicle 174 is driven between the base units 151 to bring the first art 120*a* in between the base units, preferably close to the well base member.

It is envisaged that, as the crane 111 may in an embodiment not have sufficient capacity to lift the first part 120*a*, this part 120*a* has vertically extendable legs 120*a*1 that are extended to lift the part 120*a* from the vehicle 174 so that the vehicle can be driven away. Then the legs are controllably retracted, e.g. the legs including hydraulic cylinders, so that the first parts 120*a* is lowered.

It is envisaged that the part 120*a* is lowered onto the ground but one can also envisage that the part 120*a* is lowered onto corresponding supports of the two base units 151.

it is preferred for the pipe loader 120, e.g. the part 120*a* thereof, to establish a further connection between the base units 151 in addition to the connection provided by the well base member 158 so as to increase the stability of the rig.

FIGS. 37*a*, *b* shown the provision of the second part 120*b* of the pipe loader and connection thereof to the first part 120*a*.

As shown in FIGS. 38, 39 a drilling drawworks unit 112, including one or more winches adapted to raise and lower the drill string and the top drive, is lifted, e.g. from a vehicle or from the ground, to an elevated position along the already erected mast 110 by means of the hoist device 111 on or at the top end of the mast 110. This unit 112 is then secured to the mast 110 (see FIG. 40) and cables are connected to the winch or winches of said unit, so as to allow for controlled lifting and lowering of the travelling block 185 in the mast.

FIG. 41 depicts that the travelling block 185 has been lowered to reach the top drive 180 in the middle section 110*b* and connect the top drive 180 to the block 185.

FIG. 41 also depicts that a driller's cabin 190 has been installed at the drill floor height, here onto the drill floor 140, which installation can e.g. be done with the hoist device 111. One can envisage that a driller's cabin is already installed prior to the complete erection of the mast 110, e.g. attached to a drill floor member at an earlier stage.

FIGS. 1 and 41 also shows that a BOP Blow Out Preventer 130 is arranged underneath the drill floor 141 above the well center.

FIG. 42 depicts the drill site with the rig and auxiliary equipment, e.g. a mud system, tracking pumps, etc.

The invention claimed is:

1. A method for bringing a modular transfigurable drilling rig system into an operational mode, wherein the modular transfigurable drilling rig system is composed of multiple components, which system is transfigurable between a transport mode in which the components of the system are transported and an operational mode in which the components have been assembled to a drilling rig which is adapted to drill into a well center in the ground, the system comprising:

a base structure adapted to be positioned in the operational mode on the ground adjacent the well center, the base structure comprising an assembly of interconnected parts, including a pair of base members and a drilling mast foot connection assembly defining a drilling mast foot pivot axis;

a drilling rig mast having a top end and a foot end, composed of multiple transportable mast sections, said mast sections at least including a lower section comprising the foot end of the mast, the lower section being connectable to the base structure, and a top section comprising the top end of the mast, which drilling rig mast is movable between a substantially horizontal mast assembly position, wherein the mast is assembled by interconnection of said multiple mast sections and an operational position vertically above the well center; and at least one drive assembly to move the drilling rig mast between the substantially horizontal mast assembly position and the vertical operational position, wherein the method comprises the steps of:

positioning the base structure on the ground adjacent the well centre in a C-arrangement when seen from above, such that portions of said base members extend side-by-side with a spacing there between dimensioned to receive a lower portion of the lower mast section in its substantially horizontal position;

positioning the lower mast section on a transport vehicle and moving it between the spaced base members so that the foot end of the lower mast section is brought adjacent the base structure;

pivotally connecting the foot end of the lower mast section to the drilling mast foot connection assembly of the base structure;

operating the at least one drive assembly to raise the lower mast section from the transport vehicle;

removing the transport vehicle;

positioning a subsequent drilling rig mast section which has been transported on a vehicle in a substantially horizontal position adjacent the lower mast section;

aligning the upper end of the lower mast section with a lower end of the subsequent drilling rig mast section by tilting the lower mast section downward;

connecting one end of the subsequent drilling mast section to the lower mast section; and operating the at least one drive assembly such that the drilling rig mast moves towards its vertical operational position.

2. The method according to claim 1, wherein the subsequent drilling rig mast section is a middle mast section, and wherein prior to moving the drilling rig mast to its vertical operational position the method comprises the steps of:

positioning a top section on a vehicle in a substantially horizontal position adjacent the middle mast section;

aligning the upper end of the middle mast section with a lower end of the top section by tilting the lower mast section downward; and connecting one end of the top section to the middle mast section.

3. The method according to claim 1, the system further comprising a top drive to perform drilling activities, wherein the method, prior to moving the drilling rig mast to its vertical operational position comprises the steps of:

supplying by means of a vehicle the top drive in a substantially horizontal orientation;

aligning the drilling rig mast, in at least partly assembled state and connected to the base structure, with the top drive that is in substantially horizontal orientation on the vehicle;

when aligned, connecting the top drive to the drilling rig mast; and operating the at least one drive assembly such that the drilling mast with the top drive moves towards its vertical operational position.

4. The method according to claim 3, wherein the drilling rig mast is composed of multiple sections at least including a lower mast section, middle mast section, and an upper mast section, and wherein the method comprises the steps of:

connecting the lower mast section to the base structure;

connecting the middle mast section to the lower mast section in a substantially horizontal assembly position;

aligning the middle section with the top drive that is in substantially horizontal orientation on the vehicle;

when aligned, connecting the top drive to the drilling rig mast middle section;

connecting said upper mast section to the one or more middle sections in substantially horizontal assembly position; and operating the at least one drive assembly such that the drilling mast with the top drive moves towards its vertical operational position.

5. The method according to claim 3, wherein top section of the mast includes a crown block and a travelling block, and wherein—after bringing the mast in its vertical operational position—the travelling block is connected to the top drive.

6. The method according to claim 4, wherein top section of the mast includes a crown block and a travelling block, and wherein, after bringing the mast in its vertical operational position, the travelling block is connected to the top drive.

7. The method according to claim 1, wherein the drive assembly to raise and lower the mast includes a winch and one or more cables.

8. The method according to claim 7, wherein the winch is a hydraulic winch having one or more hydraulic winch drive motors.

9. The method according to claim 1, wherein the drive assembly to raise and lower the mast includes a hydraulic cylinder.

10. The method according to claim 1, wherein the system further comprises a pipe loader, and wherein, after the mast has been brought into its vertical operative position, the pipe loader can be arranged to extend at least partly in the space between the spaced base members.

* * * * *